US012667185B2

(12) United States Patent
Vander Park

(10) Patent No.: US 12,667,185 B2
(45) Date of Patent: Jun. 30, 2026

(54) CONFIGURABLE WORKSTATION HAVING PROGRAMMABLE AND AUTOMATIC HEIGHT AND DEPTH ADJUSTMENT

(71) Applicant: NOVA-LINK LIMITED, Guelph (CA)

(72) Inventor: Antonius A. Vander Park, Caledon (CA)

(73) Assignee: NOVA-LINK LIMITED, Guelph (CA)

( * ) Notice: Subject to any disclaimer, the term of this patent is extended or adjusted under 35 U.S.C. 154(b) by 107 days.

(21) Appl. No.: 18/748,575

(22) Filed: Jun. 20, 2024

(65) Prior Publication Data

US 2025/0386927 A1 Dec. 25, 2025

(51) Int. Cl.
*A47B 21/03* (2006.01)

(52) U.S. Cl.
CPC ..... *A47B 21/0314* (2013.01)

(58) Field of Classification Search
CPC ..... A47B 87/008; A47B 21/02; A47B 21/03; A47B 21/0314; A47B 21/04; A47B 2083/006; A47B 2097/006
See application file for complete search history.

(56) References Cited

U.S. PATENT DOCUMENTS

| | | | |
|---|---|---|---|
| 5,339,750 | A | 8/1994 | Smies |
| 5,588,376 | A | 12/1996 | Seidl et al. |
| 7,878,476 | B2 | 2/2011 | Carson et al. |
| 8,051,782 | B2 | 11/2011 | Nethken et al. |
| 8,087,737 | B2 | 1/2012 | Shoenfeld |
| 8,783,193 | B2 | 7/2014 | Scharing |
| 8,893,628 | B2 | 11/2014 | Mckenzie, III et al. |
| 9,560,913 | B2 | 2/2017 | Scharing |
| 9,655,438 | B1 | 5/2017 | Shoenfeld et al. |

(Continued)

FOREIGN PATENT DOCUMENTS

WO 2003037140 A1 5/2003

OTHER PUBLICATIONS

AFC Industries, "AFC Dual-Tier Standing Table," https://afcindustries.com/product/ergonomic-stand-up-desk/, 6 pages, at least as early as Oct. 5, 2023.

(Continued)

*Primary Examiner* — Matthew W Ing
(74) *Attorney, Agent, or Firm* — Hodgson Russ LLP

(57) ABSTRACT

A configurable workstation has a base, an automatically height-adjustable work deck connected to the base, an automatically height-adjustable equipment platform connected to the base, an automatically depth-adjustable equipment carriage supported on the equipment platform for depth adjustment relative to the equipment platform and the work deck, and an equipment support rack supported on the equipment carriage to which equipment such as display monitors may be mounted. The workstation includes a controller and a user interface for commanding a set of lift legs associated with the work deck, another set of lift legs associated with the equipment platform, and a linear actuator acting between the equipment platform and the equipment carriage for depth adjustment. A secondary base, height-adjustable equipment platform, depth-adjustable equipment carriage, and equipment support rack may be added and connected to the controller and the user interface to expand the workstation.

14 Claims, 19 Drawing Sheets

(56) References Cited

U.S. PATENT DOCUMENTS

| | | | | |
|---|---|---|---|---|
| 9,999,295 | B1 | 6/2018 | Game et al. | |
| 10,039,376 | B2 | 8/2018 | Vande | |
| 10,980,339 | B2 | 4/2021 | Game et al. | |
| 2005/0150437 | A1 | 7/2005 | Chen | |
| 2009/0133609 | A1* | 5/2009 | Nethken | A47B 21/02 108/50.02 |
| 2013/0061783 | A1* | 3/2013 | Bennie | A47B 13/08 108/25 |
| 2018/0055215 | A1* | 3/2018 | Vander Park | A47B 21/02 |
| 2018/0310705 | A1* | 11/2018 | Game | A47B 21/04 |
| 2021/0368974 | A1* | 12/2021 | Sudoh | A47B 9/20 |

OTHER PUBLICATIONS

Gazelab—Kickstarter, "Gaze Desk : The Smartest Standing Desk Ever," https://w w w .kickstarter.com/projects/gazelab/gaze-desk-the-smartest-standing-desk-ever?lang=zh, 28 pages, at least as early as Oct. 5, 2023.

Winsted, "Impulse Dual Sit/Stand Control Consoles," https://w w w .w insted.com/impulse-dual-sit-stand-consoles/, 9 pages, at least as early as Oct. 5, 2023.

Vertiv, "Control Room Infrastructure," 32 pages, Dec. 2017.

* cited by examiner

CONFIGURABLE WORKSTATION HAVING PROGRAMMABLE AND AUTOMATIC HEIGHT AND DEPTH ADJUSTMENT

FIELD OF THE DISCLOSURE

The present disclosure relates to workstations at which display monitors and other equipment is made available to one or more operators.

BACKGROUND OF THE DISCLOSURE

In work environments that require intensive communication systems (e.g. air traffic control towers, military command centers, emergency response centers, financial trading centers, etc.), an operator or user may need to interact with online persons, information, and images while simultaneously monitoring events and communicating in person directly with co-workers present in the same room with the operator. The operator may need access to several equipment interfaces (e.g. touch screens, display screens, speakers, cameras, input devices, etc.) while maintaining the capacity to see and be seen by others in the work environment.

Workstations currently found in these work environments may limit the capacity of the operator to see and be seen. For example, multiple display screens arranged one above another may reach a height such that the operator's viewing sightlines with other personnel are blocked.

Another drawback of existing workstations is that they offer limited options for arranging equipment in a comfortable and ergonomic configuration for a particular operator. For example, many current workstations may only be configured for an operator who is sitting, standing, or of a certain height. When an operator prefers sitting to standing, or vice versa, or if an operator's height is atypical, it may be very difficult or impossible to orient multiple display screens at optimal viewing angles and position other equipment within easy reach of the operator. As a result, the operator may experience strain and fatigue. This drawback may be a serious problem for people with disabilities. For these reasons, statutory and industry ergonomic standards have been established to promote ergonomic design. Among these are standards required under the Americans With Disabilities Action (ADA) and standards adopted and promulgated by the American National Standards Institute in coordination with the Business and Institutional Furniture Manufacturers Association (ANSI/BIFMA standards).

Also, different operators will have different visual acuity and thus will prefer different focal distances from display screens at a workstation. While attempts have been made in the prior art to enable easy depth adjustment of display screens, most solutions known to the applicant are directed toward manual adjustment of a single display screen. For complex workstations having a large display screen or an array of display screens imposing a significant weight load, automated depth adjustment systems of the prior art are complex and involve movement of the entire support structure (floor to display) on which the large display or array of displays is supported. As a result, stability and smoothness of travel of the display screens during depth adjustment are inadequate. Moreover, the complex workstation structure requires trained personnel to install and is difficult and time consuming to relocate after installation. Known console workstations generally do not have capacity for multiple large (e.g., 55-inch) display monitors and do not offer depth adjustments.

Information technology technicians and user-operators often complain that adjusting and aligning multiple monitors in preferred positions free of gaps is difficult and requires substantial time and effort.

What is needed is a configurable workstation that addresses the issues mentioned above.

SUMMARY OF THE DISCLOSURE

The present disclosure provides a configurable workstation that improves upon the prior art by addressing the issues described above.

A workstation according to a first embodiment generally comprises a base, a work deck connected to the base, a work deck height adjustment means for automatically adjusting a height of the work deck relative to the base, an equipment platform connected to the primary base, a platform height adjustment means for automatically adjusting a height of the equipment platform relative to the base, an equipment carriage supported on the equipment platform, a carriage depth adjustment means for automatically adjusting a depth of the equipment carriage relative to the equipment platform and the work deck, and an equipment support rack supported on the primary equipment carriage. The workstation further comprises a controller in communication with the work deck height adjustment means, the platform height adjustment means, and the carriage depth adjustment means, and a user control interface in communication with the controller and configured to enable a user to issue adjustment commands to the work deck height adjustment means, the primary platform height adjustment means, and the primary carriage depth adjustment means by way of the controller.

The equipment support rack may support a plurality of display monitors, wherein the workstation allows for smooth and stable automated height and depth adjustment of the display monitors and independent height adjustment of the work deck. The workstation provides multiple degrees of freedom within a three-dimensional spatial spectrum so that users may easily configure the workstation to meet their individual ergonomic preferences.

A workstation according to a second embodiment is similar to that of the first embodiment, but further comprises a secondary base, a secondary equipment platform, a secondary equipment carriage, and a secondary equipment support. The secondary equipment platform has similar height adjustment means and the secondary equipment carriage has similar depth adjustment means.

The workstations disclosed herein are not only user-friendly for the end user, they are user-friendly for movers, installers, information technology personnel, and owners because they are modular in construction and have no floor-mounted tracks or framework.

BRIEF DESCRIPTION OF THE DRAWING VIEWS

The nature and mode of operation of the present invention will now be more fully described in the following detailed description taken with the accompanying drawing figures, in which.

DETAILED DESCRIPTION OF THE INVENTION

Figure 1:
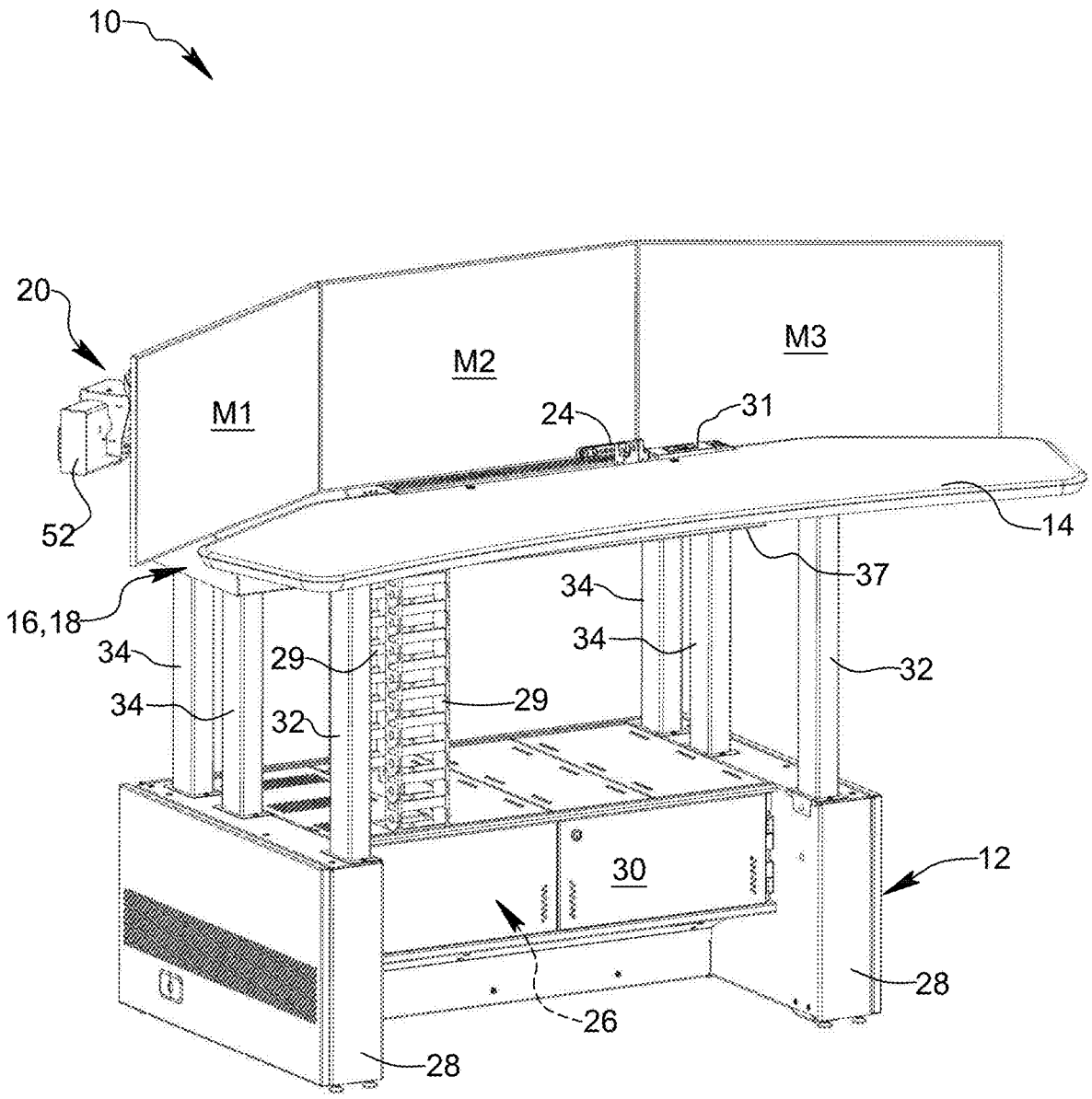
FIG. 1 is a front-left perspective view of a configurable workstation formed in accordance with a first embodiment of the present disclosure, shown supporting a plurality of display screens.
Figure 2:
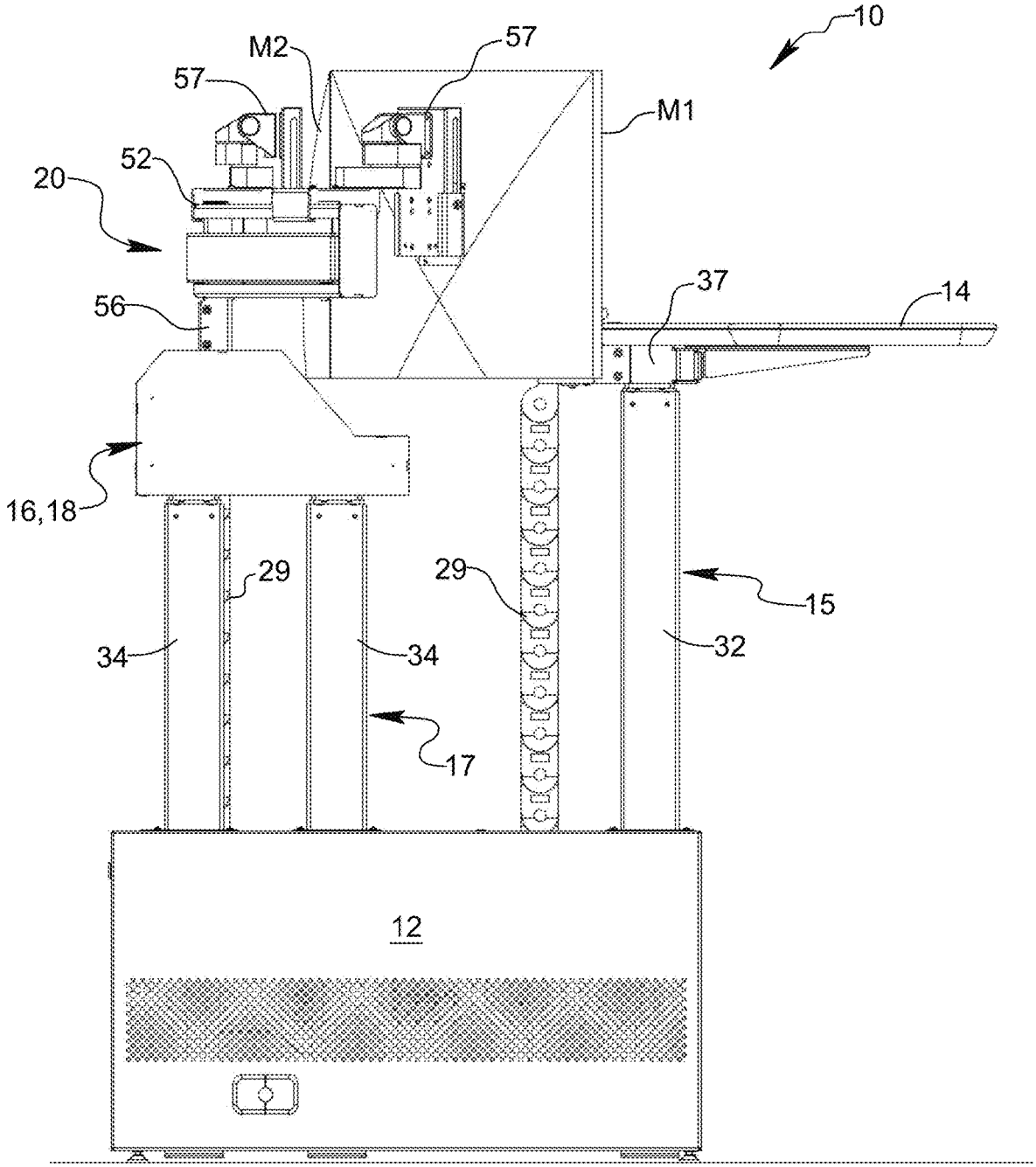
FIG. 2 is a left side elevation view of the configurable workstation shown in FIG. 1.
Figure 3:
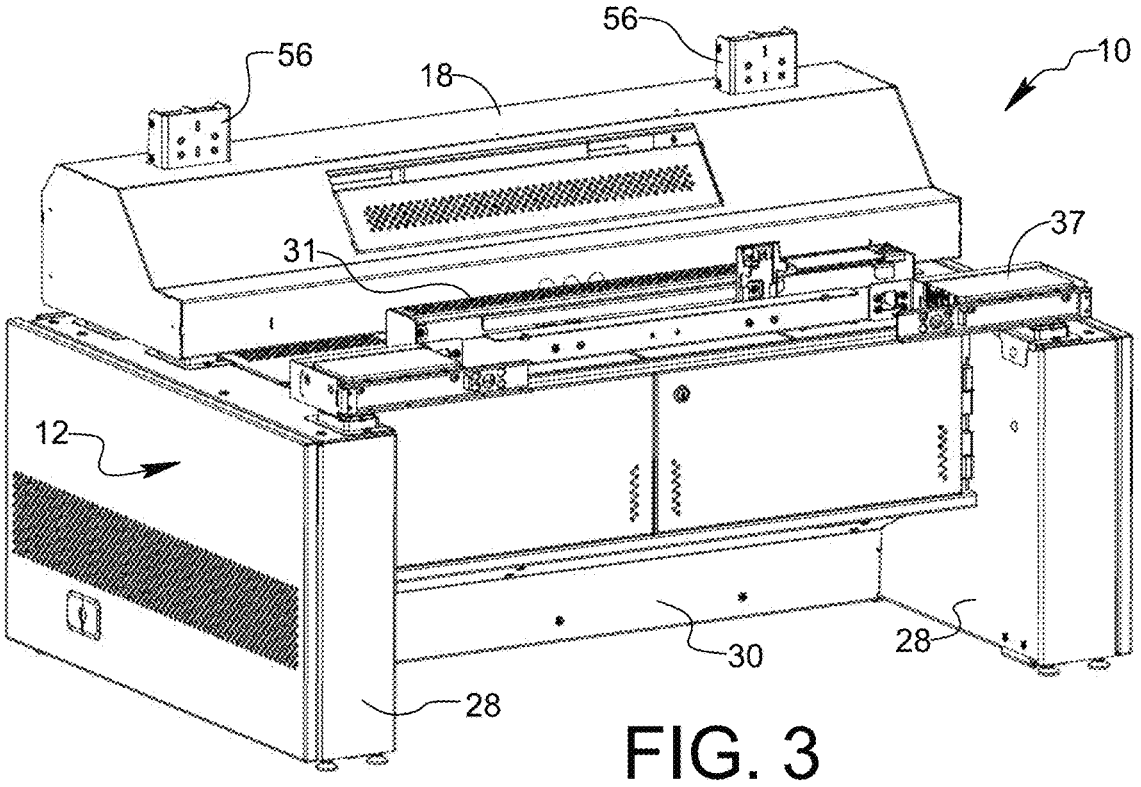
FIG. 3 is a front-left perspective view of the configurable workstation, wherein a work deck and an equipment support rack of the configurable workstation are removed for clarity.
Figure 4:
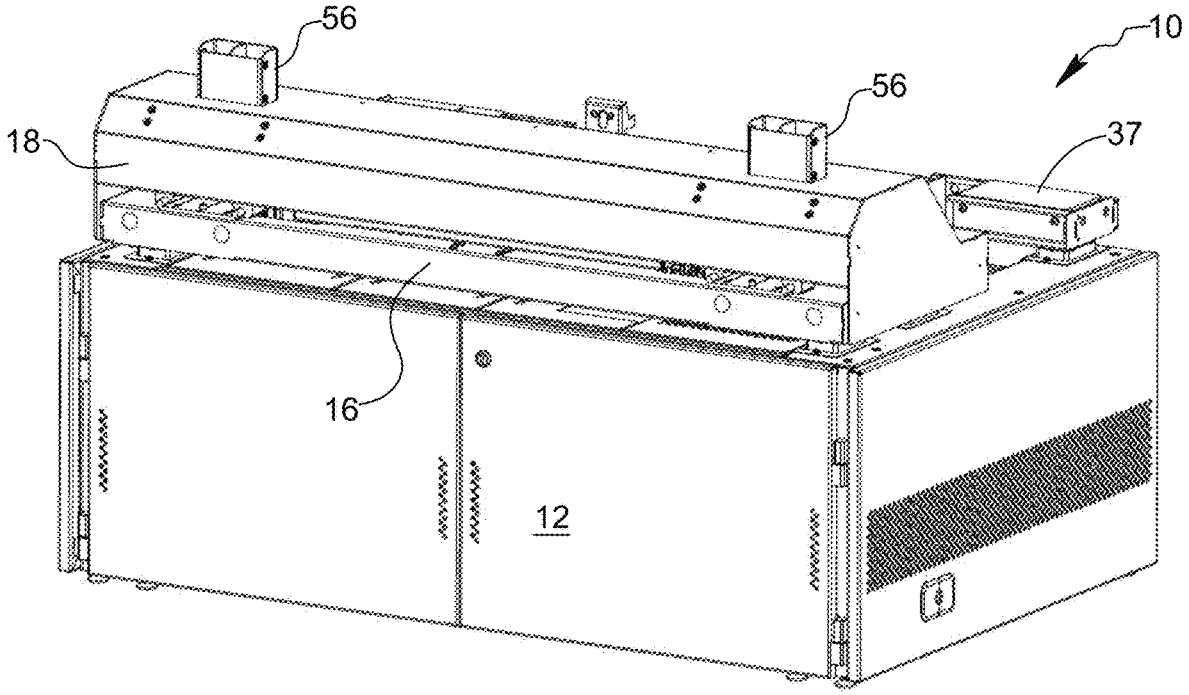
FIG. 4 is a rear-left perspective view of the configurable workstation wherein the work deck and equipment support rack of the configurable workstation are removed for clarity.

Reference is made initially to FIGS. 1-9B illustrating a configurable workstation 10 formed in accordance with a first embodiment of the present disclosure. Workstation 10 generally comprises a base 12, a work deck 14 connected to base 12, an equipment platform 16 connected to base 12, an equipment carriage 18 supported on equipment platform 16, and an equipment support rack 20 supported on the equipment carriage 18 for travel therewith. Workstation 10 also comprises work deck height adjustment means 15 for automatically adjusting a height of work deck 14 relative to base 12, platform height adjustment means 17 for automatically adjusting a height of equipment platform 16 relative to base 12, and carriage depth adjustment means 19 for automatically adjusting a depth of equipment carriage 18 relative to equipment platform 16 and work deck 14. Workstation 10 further comprises a controller 22 (see FIG. 8) in communication with work deck height adjustment means 15, platform height adjustment means 17, and carriage depth adjustment means 19. Finally, workstation 10 comprises a user control interface 24 in communication with controller 22 and configured to enable a user to issue adjustment commands to work deck height adjustment means 15, the platform height adjustment means 17, and carriage depth adjustment means 19 by way of the controller 22.

Base 12 may be embodied as a console (i.e., a floor cabinet) having an interior storage space 26. In the illustrated embodiment, base 12 has a pair of laterally-spaced sidewalls 28 and a recessed central cabinet 30 between the two sidewalls 28. In one embodiment, base 12 is 17.75 inches (45 cm) high by 30.75 inches (78 cm) deep by 48 inches (122 cm) wide. Other dimensions are possible as a matter of design choice, including a wider version measuring 60 inches (152 cm) in width. The depth dimension may be chosen so that monitors supported by workstation 10 (e.g., monitors M1, M2, and M3 in FIG. 1) are adjustable in a depth direction of the workstation within an optimal focal range of 30 inches (76 cm) to 24 inches (61 cm), and so base 12 is able to pass through a standard three-foot door frame having a net opening or gap of 33 inches (84 cm). To comply with the ADA, base 12 may be sized to facilitate a range of vertical travel for a top surface of work deck 14 from 22 inches (56 cm) through 48 inches (122 cm) above floor level. Base 12 may be fabricated from sheet metal pieces.

Work deck 14 may be a monolithic piece having a flat top surface. Work deck 14 may be connected to base 12 by a deck platform 37 and a pair of automatically extendable and retractable lift legs 32 respectively anchored in base sidewalls 28. A width of work deck 14 may be subject to design choice, and applicant contemplates the width of work deck 14 being in a range from 46 inches (117 cm) through 96 inches (244 cm). Thus, the opposite lateral sides of work deck 14 may be cantilevered out from an associated lift leg 32 to extend substantially beyond the sidewalls 28 of base 12. Work deck 14 may include a power and data connector strip 31 which may be mounted to deck platform 37 along a rear edge of the work deck. Power and data cables may be concealed and guided between the interior of base 12 and connector strip 31 of work deck 14 by a flexible cable conduit 29. Connector strip 31 may include outlets and ports for connecting power and data cables to computer equipment stored within interior storage space 26 of base 12.

Equipment platform 16 may be a rectangular assembly connected to base 12 by four automatically extendable and retractable lift legs 34 respectively located at the corners of equipment platform 16. Lift legs 34 may be anchored in base sidewalls 28, two lift legs 34 in each sidewall 28. The four lift legs 34 are located at corners of equipment platform 16 so as to minimize cantilevered lateral extensions and enhance stability when workstation 10 is loaded with equipment as described in greater detail below.

Equipment carriage 18 is supported on equipment platform 16 for vertical travel with the equipment platform 16 upon adjustment (i.e., extension and retraction) of lift legs 34. Equipment carriage 18 is mounted on equipment platform 16 in a manner permitting equipment carriage 18 to move back and forth in a depth direction of workstation 10 by a plurality of slide rails 36 and a plurality of corresponding followers 38 slidably mating with slide rails 36. In the illustrated embodiment, slide rails 36 are fixed to equipment platform 16 at opposite lateral sides of the equipment platform and mating followers 38 are fixed to equipment carriage 18. The arrangement of slide rails 36 and followers 38 may be reversed, wherein slide rails 36 are fixed to equipment carriage 18 and followers 38 are fixed to equipment platform 16. Each slide rail 36 may have a rectangular plate portion 40 and a pair of parallel cylindrical guides 42 extending along opposite lateral side edges of plate portion 40 and raised relative to plate portion 40. Each follower 38 may include a cylindrical guide passage 44 sized to slidably receive a cylindrical guide 42 of a corresponding slide rail 36. Slide rails 36 are preferably heavy-duty one-piece extruded slide rails and at least two followers 38 spaced apart in the depth direction are mated with each guide 42 on slide rails 36 for strength and smooth back and forth movements of equipment carriage 18 relative to equipment platform 16. In the depicted embodiment, slide rails 36 are nearly aligned overtop lift legs 34 for substantially direct load transfer.

Travel limits of equipment carriage 18 relative to equipment platform 16 in forward and rearward directions may be mechanically implemented by fixedly attaching an upstanding detent element 46 to equipment platform 16 for engagement with a rear stop edge 48A on equipment carriage 18 when equipment carriage 18 is at its forward travel limit and with a front stop edge 48B when equipment carriage 18 is at its rearward travel limit. Rear stop edge 48A and front stop edge 48B may be defined by opposite ends of a slot or cutout 48 extending in the depth direction along a lateral side of equipment carriage 18. Mechanical travel limits may be implemented on each opposite lateral side of equipment carriage 18.

Figure 5:
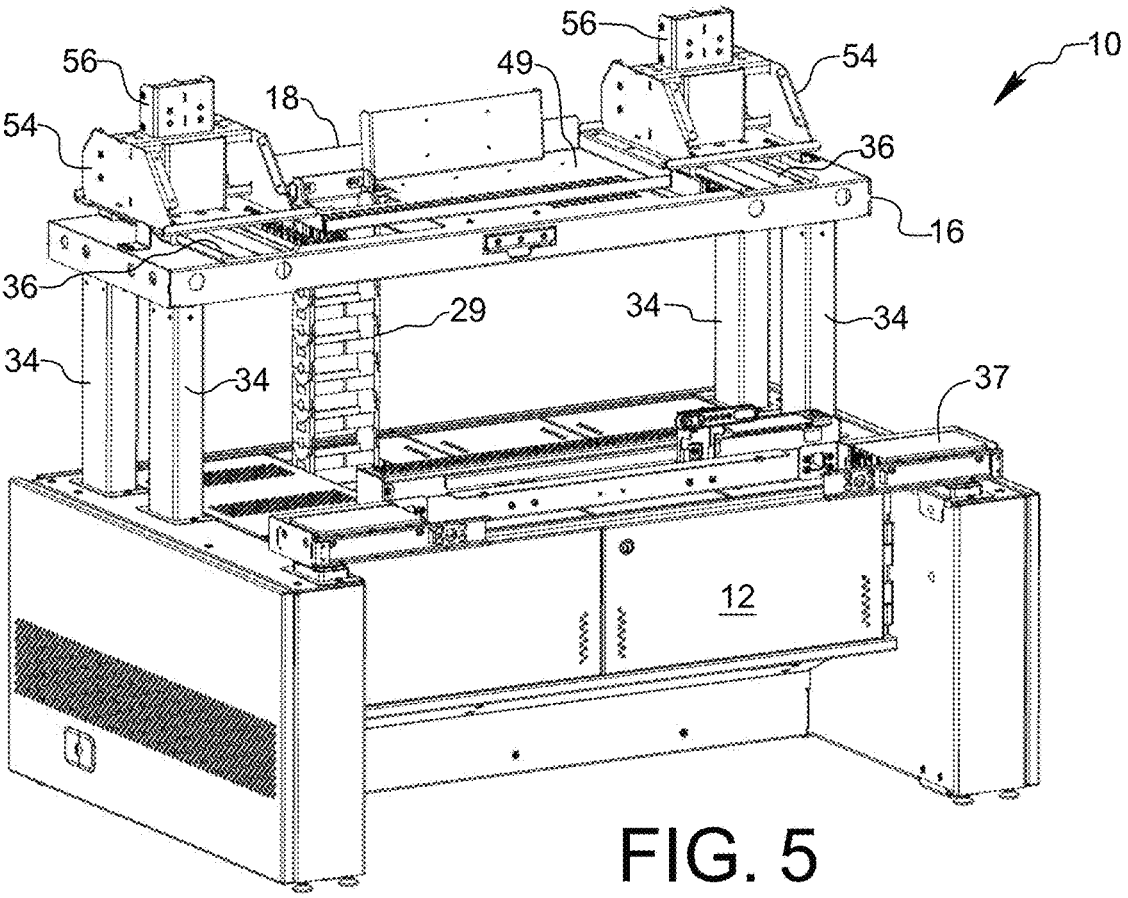
FIG. 5 is a perspective view similar to that of FIG. 3, wherein a cover of an equipment carriage of the configurable workstation is removed to reveal internal structure.
Figure 6:
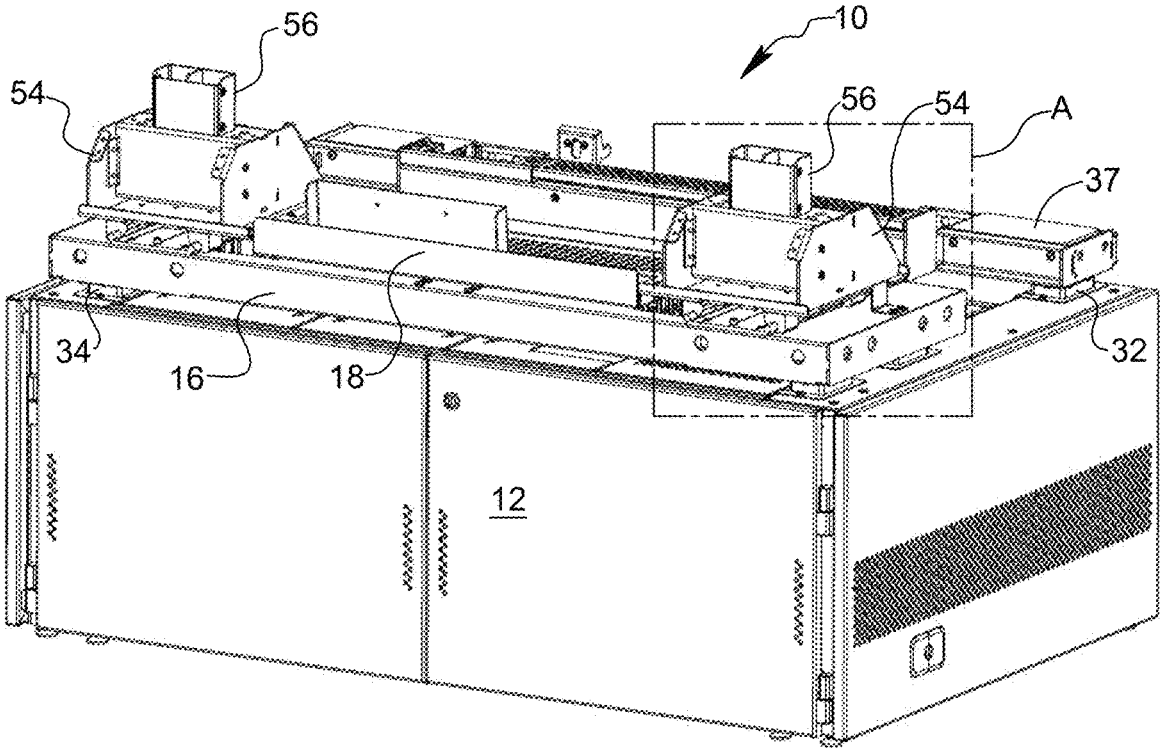
FIG. 6 is a perspective view similar to that of FIG. 4, wherein the cover of the equipment carriage is removed to reveal internal structure.
Figure 7:
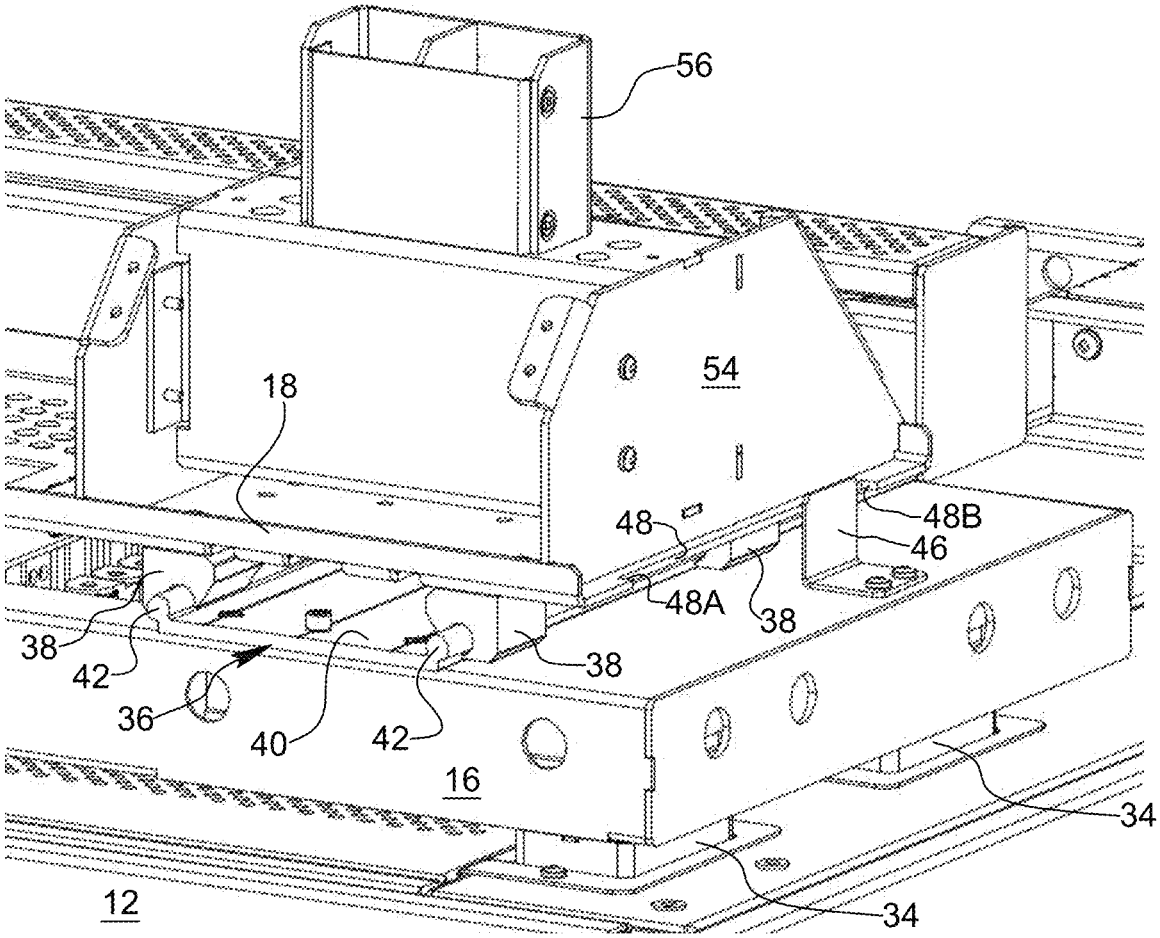
FIG. 7 is an enlarged view of region A in FIG. 6.
Figure 8:
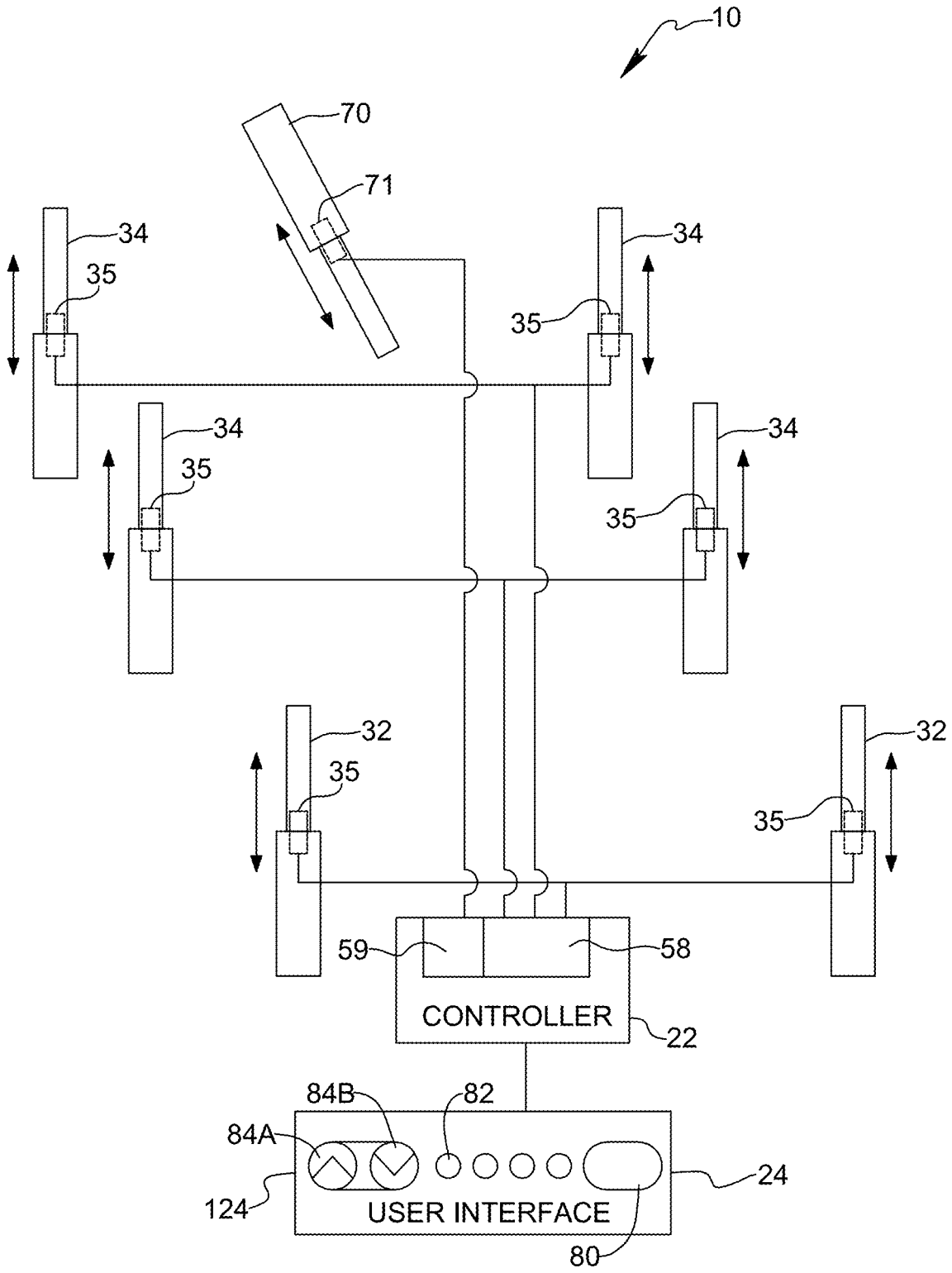
FIG. 8 is a schematic block diagram illustrating automatic control architecture of the configurable workstation of the first embodiment.

As best seen in FIG. 5, equipment carriage 18 may include a cable tray 49 for receiving electrical power and data cables (not shown). Power and data cables may be concealed and guided between the interior of base 12 and cable tray 49 of equipment carriage 18 by another flexible cable conduit 29. Equipment carriage 18 may be fabricated from sheet metal pieces.

Equipment support rack 20 may include vertical support posts 50 and one or more horizontal equipment support rails 52 coupled to the support posts 50. Equipment rack 20 may be supported on equipment carriage 18 by reinforced support braces 54 on equipment carriage 18. Support braces 54 on equipment carriage 18 may be located directly above slide rails 36 for direct load transfer. Each support brace 54 may include a support sleeve 56 sized to slidably receive a bottom end portion of two associated support posts 50 and configured such that the support posts 50 may be secured within the support sleeve, for example by tightening fastening elements (not shown). Each equipment support rail 52 may be mounted on support posts 50 at a selected height position, and may be configured to enable one or more display screens (i.e., monitors) M1-M3 to be mounted thereon by adjustable attachment brackets 57. Each equipment support rail 52 may include angled segments for accommodating a central display screen M2 flanked by two lateral display screens M1 and M3 angled inward toward the central display screen M2. In one embodiment, equipment support rack 20 is built to have at least one-thousand pounds of support capacity.

Work deck height adjustment means 15 for automatically adjusting a height of work deck 14 relative to base 12 may include lift legs 32 in cooperation with controller 22 and user control interface 24. Similarly, platform height adjustment means 17 for automatically adjusting a height of equipment platform 16 relative to base 12 may include lift legs 34 in cooperation with controller 22 and user control interface 24. In one embodiment, lift legs 32 and 34 may be commercially available LINAK DESKLIFT™ DL6 with PIEZO™ electric lifting columns from Linak U.S. Inc. of Louisville Kentucky, Part No. DL6101BNE665518, which use telescoping columns (legs) each driven by a compact electric motor 35. Controller 22 may include a lift leg control module 58 comprising motor control boxes available from Linak U.S. Inc. intended for use with lift legs 32 and 34 to drive the lift leg motors. For example, Linak's CBD6S control box may be suitable for practicing the present invention. Controller 22 may be stored, for example, within the interior storage space 26 of base 12.

User control interface 24 may be mounted to deck platform 37 near the rear edge of work deck 14, to a front edge of work deck 14, or any suitable location for user access such that the user control interface 24 travels with work deck 14 during height adjustment of the work deck. In one embodiment, user control interface 24 may include a display 80, a movement zone selection button 82, and a pair of directional movement buttons 84A, 84B. In such an embodiment, movement zone selection button 82 may be pressed to toggle sequentially among a first zone wherein lift legs 32 and 34 are driven in unison to adjust the height of work deck 14 and equipment platform 16 at the same time, a second zone wherein only lift legs 34 are driven to adjust the height of equipment platform 16 while the height of work deck 14 remains unchanged, a third zone wherein only lift legs 32 are driven to adjust the height of work deck 14 while the height of equipment platform 16 remains unchanged, and a fourth zone described below. The number of the currently selected movement zone (first, second, third, or fourth) may be displayed by display 80. If one of the first through third movement zones is selected, then directional movement button 84A may be pressed to drive the selected movement zone lift legs in an upward (i.e., extension) direction, and directional movement button 84B may be pressed to drive the selected movement zone lift legs in a downward (i.e., retraction) direction.

Figure 9A:
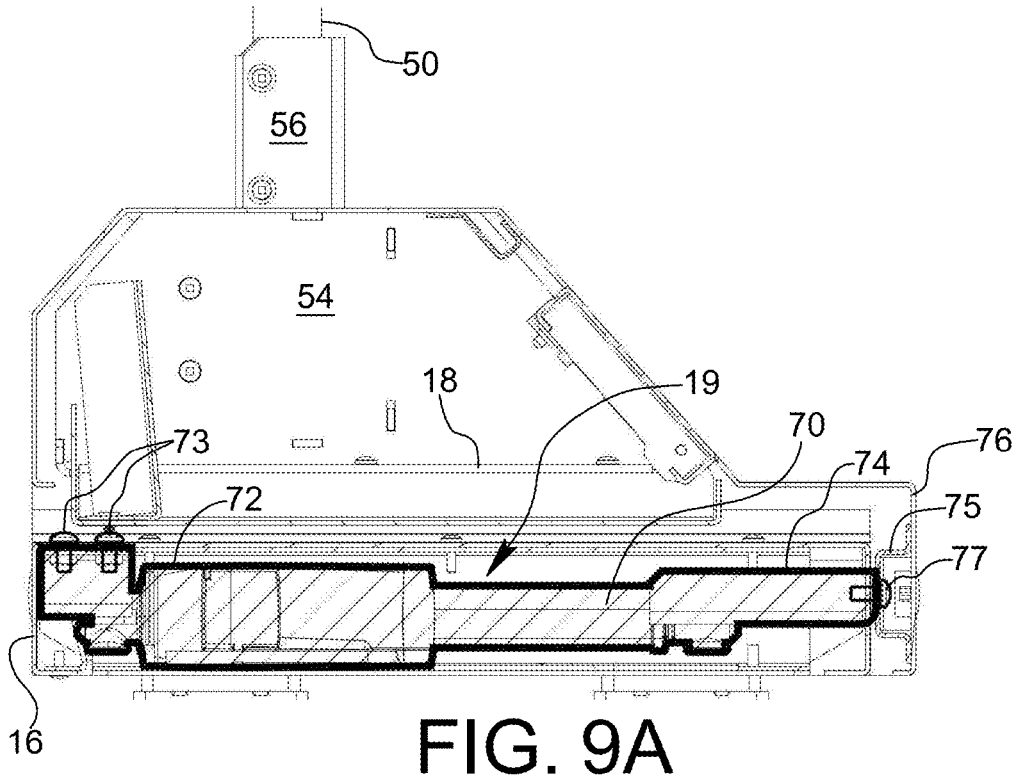
FIG. 9A is a cross-sectional view of an equipment platform and the equipment carriage of the configurable workstation illustrating a carriage depth adjustment means of the configurable workstation, wherein the carriage depth is adjusted to its rearward travel limit.
Figure 9B:
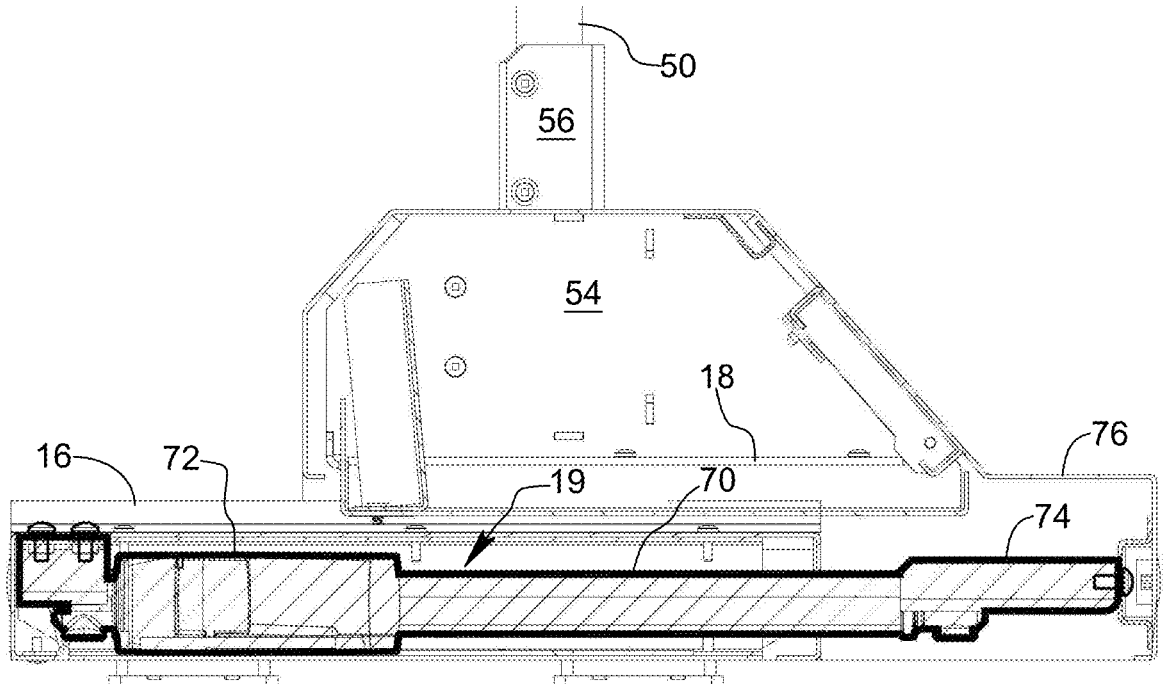
FIG. 9B is a view similar to that of FIG. 9A, wherein the carriage depth is adjusted to a forward travel limit.

Reference is now made to FIGS. 9A and 9B. Carriage depth adjustment means 19 for automatically adjusting a depth of equipment carriage 18 relative to equipment platform 16 and work deck 14 may include an electromechanical linear actuator 70 in cooperation with controller 22 and user control interface 24. Electromechanical linear actuator 70 may include an electric drive motor 71 and gearing to extend and retract a rear portion 72 and a front portion 74 of actuator 70 relative to one another. The rear portion 72 of linear actuator 70 may be attached to equipment platform 16 adjacent a rear wall of the equipment platform by fasteners 73, and the front portion 74 of linear actuator 70 may be attached to equipment carriage 18 at a front wall of a cover 76 of the equipment carriage 18 by a U-mount 75 and fasteners 77. Linear actuator 70 may be, for example, a LINAK LA23 DESKLINE™ actuator available from Linak U.S. Inc. under Part No. 2302001205130A4. Controller 22 may include an actuator control module 59 comprising electronics configured for controlling linear actuator 70. As mentioned above, user control interface 24 may allow for the selection of a fourth movement zone. In the fourth movement zone setting, only linear actuator 70 is driven to adjust the horizontal depth of equipment carriage 18 while the height of work deck 14 and equipment platform 16 remain unchanged. If the fourth movement zone is selected, then directional movement button 84A may be pressed to drive linear actuator 70 in a forward (i.e., extension) direction, and directional movement button 84B may be pressed to drive linear actuator 70 in a rearward (i.e., retraction) direction. User control interface 24 may be embodied as a LINAK DPF with display available from Linak U.S. Inc. under Part No. DPF4T00-012016.

Controller 22 may be configured to vertically adjust lift legs 32 associated with work deck 14 independently of lift legs 34 associated with equipment platform 16. Controller 22 may also be configured to drive all lift legs 32, 34 in unison, whereby both work deck 14 and equipment rack 20 may be raised and lowered using a single button or input command, as may be desirable for adjusting the entire workstation 10 between a low elevation for a seated user and a higher elevation for a standing user. Controller 22 may be configured to provide predetermined settings and user-programmed settings for lift legs 32, lift legs 34, and linear actuator 70. Configuration of controller 22 may be realized through the use of executable software instructions stored in memory associated with controller 22. The software instructions may include fixed routines and routines that incorporate user-modifiable parameters or settings entered via user interface 24.

Figure 10A:
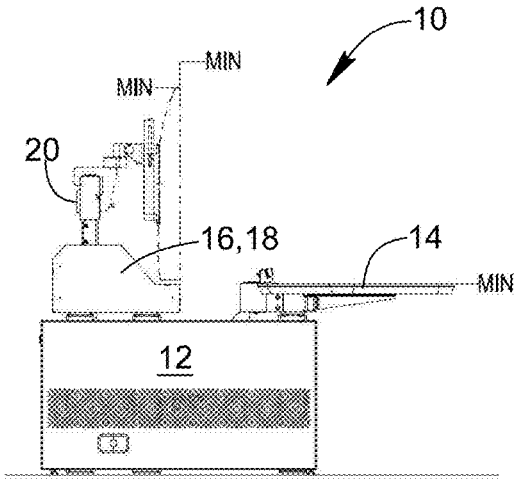
FIG. 10A is a left side elevation view of a variant of the configurable workstation, wherein the work deck and the equipment platform are adjusted to their lowest height settings and the carriage depth is adjusted to its rearward travel limit.
Figure 10B:
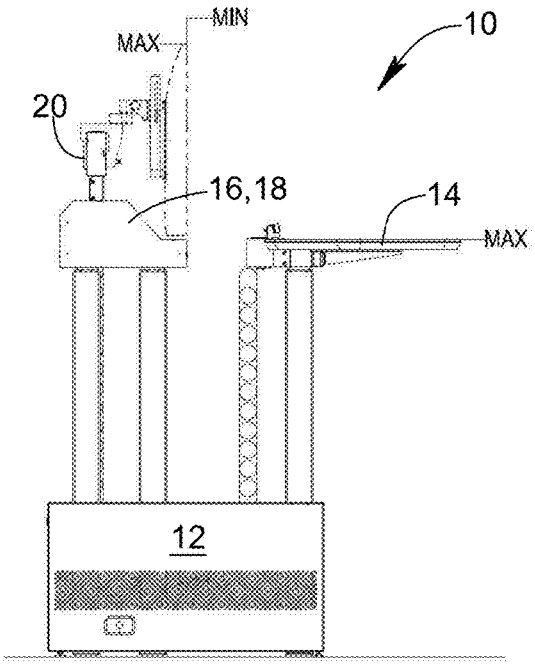
FIG. 10B is a view similar to that of FIG. 10A, wherein the work deck and the equipment platform are adjusted to their highest height settings and the carriage depth is adjusted to its rearward travel limit.
Figure 10C:
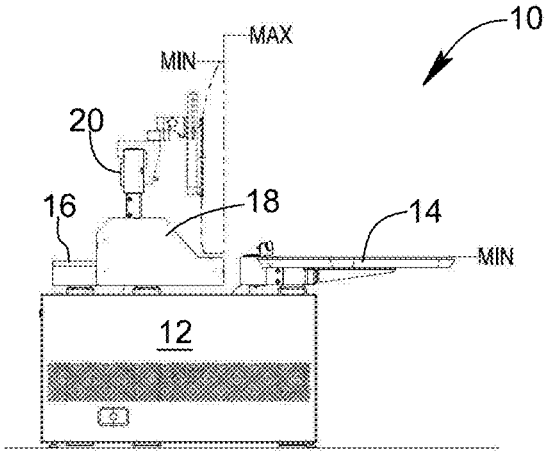
FIG. 10C is a view similar to that of FIG. 10A, wherein the work deck and the equipment platform are adjusted to their lowest height settings and the carriage depth is adjusted to its forward travel limit.
Figure 10D:
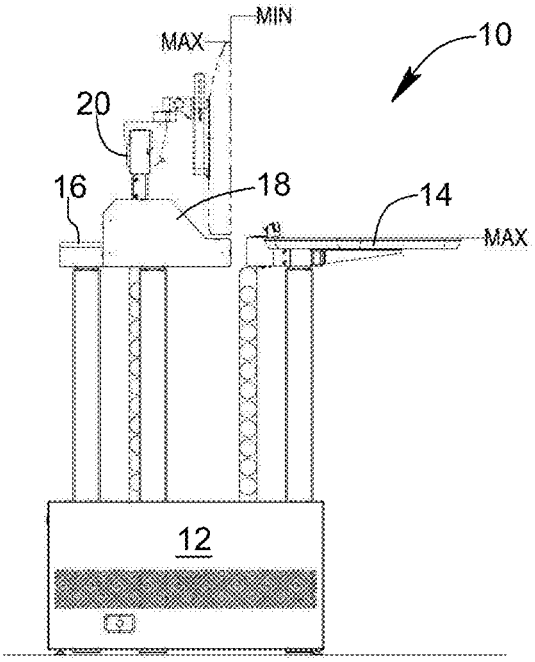
FIG. 10D is a view similar to that of FIG. 10A, wherein the work deck and the equipment platform are adjusted to their highest height settings and the carriage depth is adjusted to its forward travel limit.

FIGS. 10A-10D illustrate possible adjustment travel limits for work deck 14, equipment platform 16, and equipment carriage 18. For sake of clarity, FIGS. 10A-10D depict a variant of configurable workstation 10 wherein equipment support rails 52 are straight rather than angled. In FIGS. 10A and 10C, lift legs 32 are fully retracted and work deck 14 is at its lowest height setting. As mentioned above, the components of workstation 10 may be configured such that a top surface of work deck 14 is 22 inches (56 cm) above floor level at this setting. Also in FIGS. 10A and 10C, lift legs 34 are fully retracted and equipment platform 16 is adjusted to its lowest height setting which may be generally level with work deck 14. In FIGS. 10B and 10D, lift legs 32 are fully extended and work deck 14 is at its highest height setting. The components of workstation 10 may be configured such that the top surface of work deck 14 is 48 inches (122 cm) above floor level at this setting. Also in FIGS. 10B and 10D, lift legs 34 are fully extended and equipment platform 16 is adjusted to its highest height setting which may again be generally level with work deck 14. Of course, work deck 14 and equipment platform 16 may be adjusted to different height settings within their respective vertical travel ranges. As may be seen, the height of equipment carriage 18 and monitors M1-M3 is dependent upon the height setting of equipment platform 16.

In FIGS. 10A and 10B, linear actuator 70 (not visible) is fully retracted such that equipment carriage 18 is adjusted to its rearward travel limit relative to equipment platform 16, thereby positioning monitors M1-M3 furthest from work deck 14 and a user. In FIGS. 10C and 10D, linear actuator 70 (not visible) is fully extended such that equipment carriage 18 is adjusted to its forward travel limit relative to equipment platform 16, thereby positioning monitors M1-M3 closest to work deck 14 and a user. In one embodiment, the travel range of equipment carriage 18 relative to equipment platform 16 in the depth direction is approximately 5 inches (13 cm), and components of workstation 10 may be configured such that display screens of monitors M1-M3 are adjustable in the depth direction essentially within the optimal focal range of 30 inches (76 cm) to 24 inches (61 cm) from the user. As may be appreciated, monitor depth adjustment is achieved independently without adjusting the depth of base 12, work deck 14, and/or equipment platform 16.

Figure 11B:
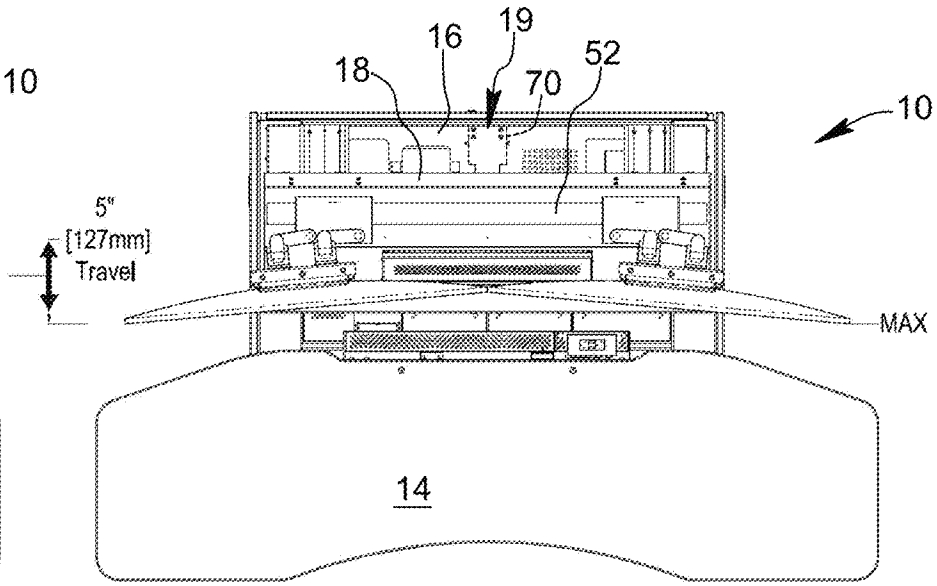
FIG. 11B is a view similar to that of FIG. 11A, wherein the carriage depth is adjusted to its rearward travel limit.
Figure 11A:
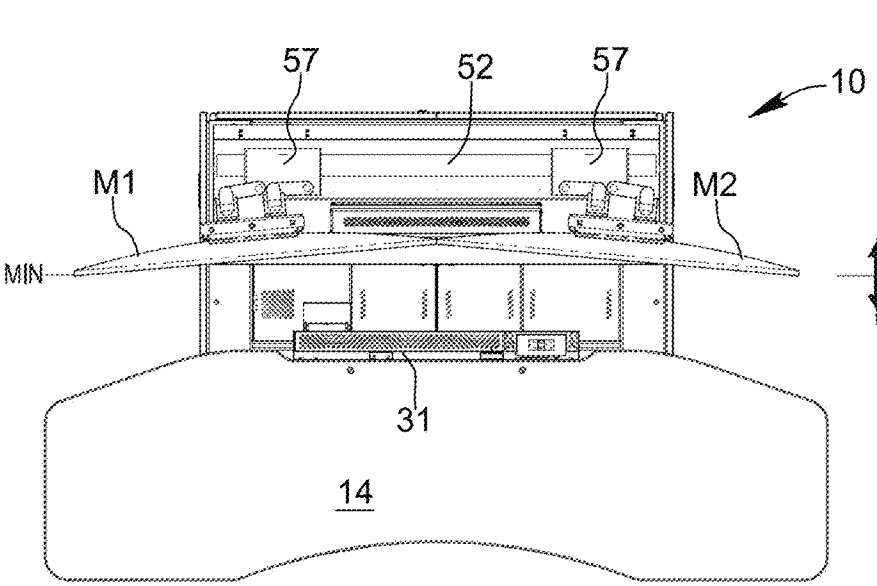
FIG. 11A is a top plan view of the variant of the configurable workstation, wherein the carriage depth is adjusted to its rearward travel limit.

FIGS. 11A and 11B illustrate depth adjustment travel limits as viewed from above. In FIG. 11A, linear actuator 70 (not visible) is fully retracted such that equipment carriage 18 is adjusted to its rearward travel limit relative to equipment platform 16, thereby positioning monitors M1 and M2 furthest from work deck 14 and a user. In FIG. 11B, linear actuator 70 (not visible) is fully extended such that equipment carriage 18 is adjusted to its forward travel limit relative to equipment platform 16, thereby positioning monitors M1 and M2 closest to work deck 14 and a user. As may be seen, the depth position of work deck 14 remains unchanged.

Figure 12A:
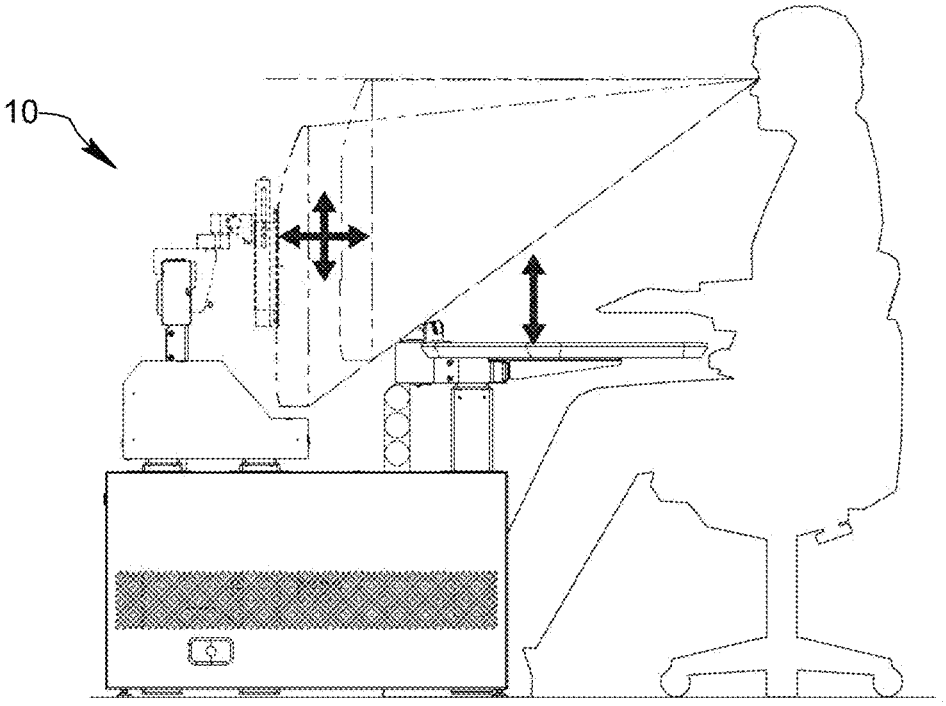
FIGS. 12A and 12B are left side elevation views illustrating user positions and adjustability degrees of freedom of the configurable workstation.
Figure 12B:
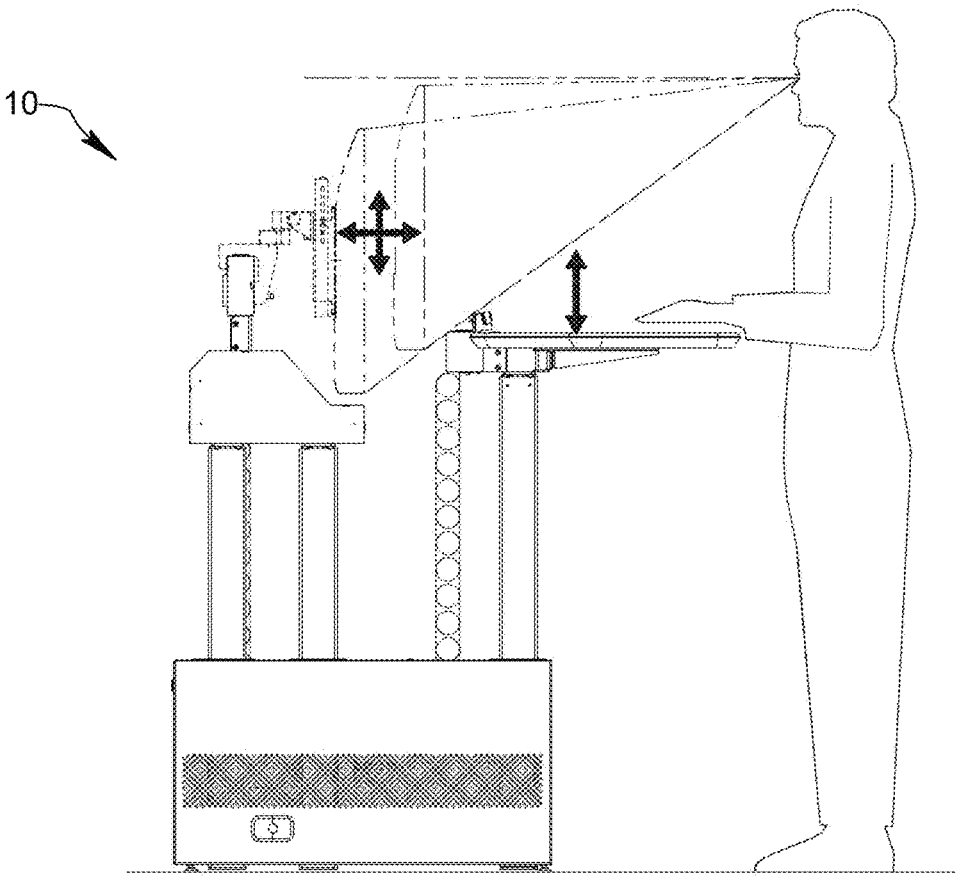

FIGS. 12A and 12B illustrate adjustment degrees of freedom available to a user in both the sitting and standing positions. As may be understood, full visibility of monitors M1 and M2 is retained even when the monitors are recessed such that a lower edge each monitor is below the height level of the top surface of work deck 14. Advantageously, the user may adjust the monitors M1 and M2 to have "over the top" visibility when sitting and standing, thereby enabling interaction with standing and sitting coworkers. A user may lower and move the monitors backwards (away) so as to have simultaneous complete visibility of the recessed monitors and the greater work space overtop the monitors. The automated adjustment movements provided by workstation 10 effectively provide a three-dimensional monitor spectrum or zone available to a user in both sitting and standing positions.

Figure 13:
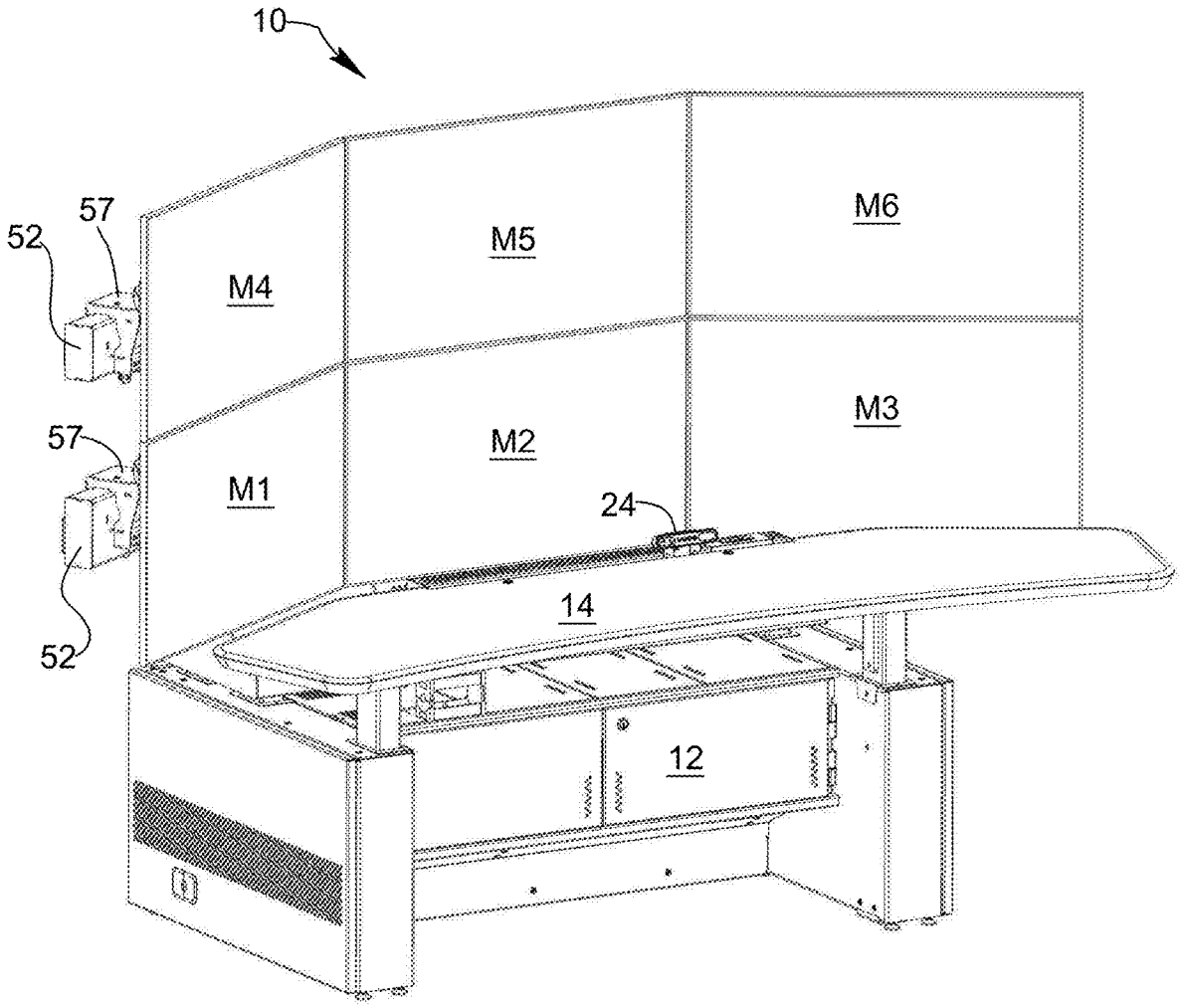
FIG. 13 is a perspective view showing the configurable workstation of the first embodiment supporting two rows of display screens.
Figure 14:
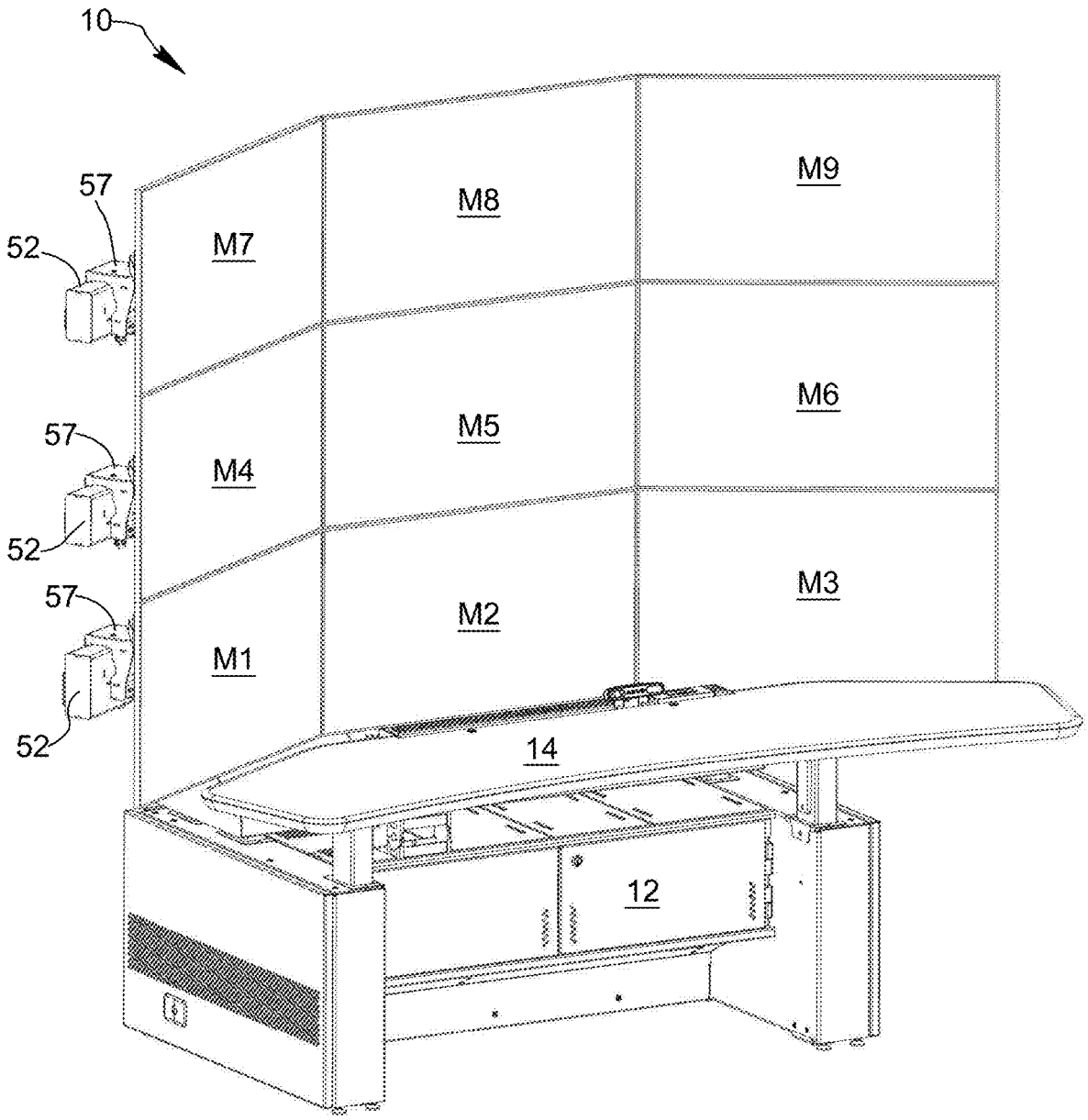
FIG. 14 is a perspective view showing the configurable workstation of the first embodiment supporting three rows of display screens.
Figure 15:
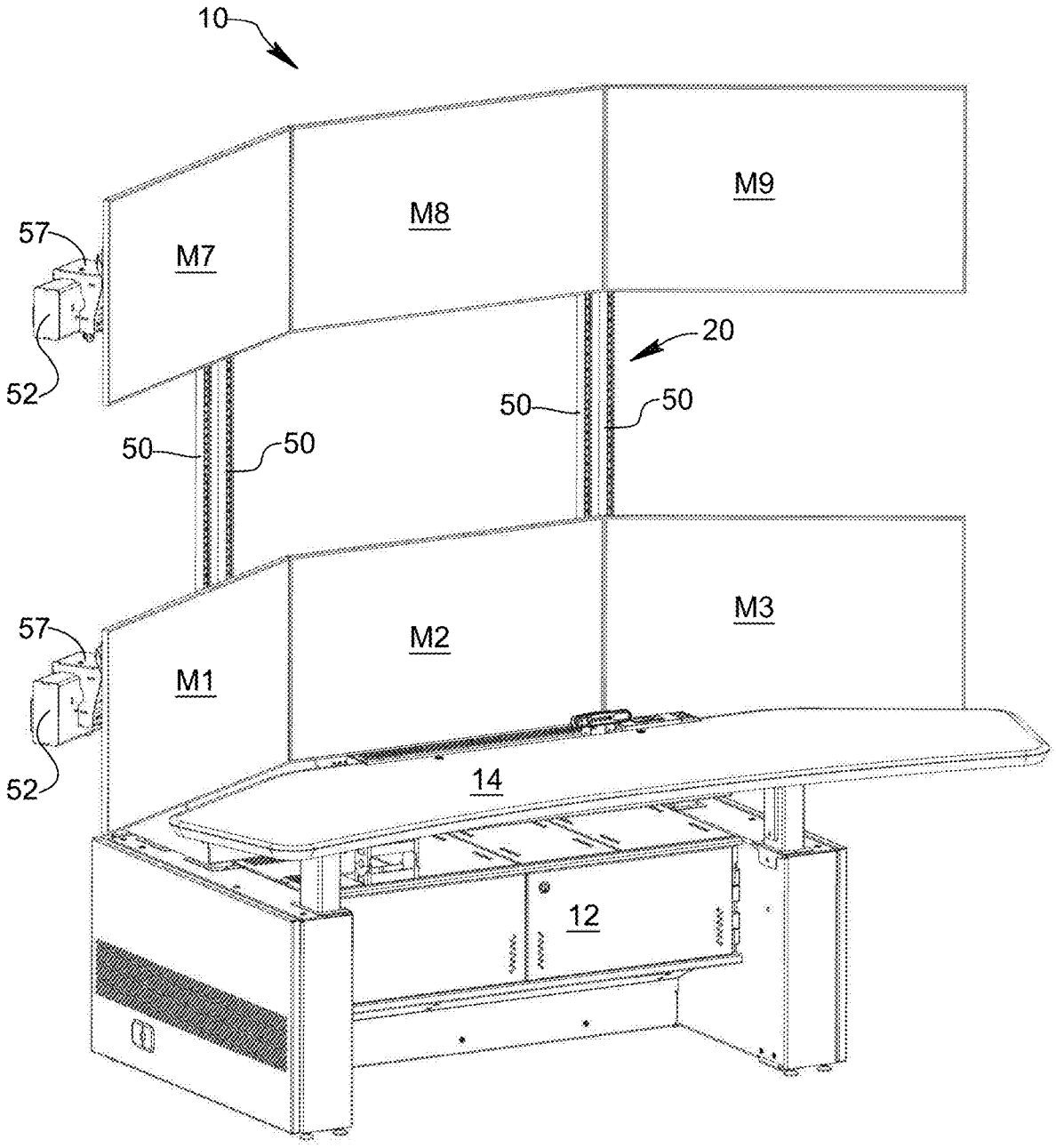
FIG. 15 is a perspective view showing the configurable workstation of the first embodiment supporting two rows of display screens separated by a viewing gap.

FIGS. 13-15 illustrate multiple monitor array configurations possible on equipment rack 20. In FIG. 13, equipment rack 20 is configured to have two equipment support rails 52 spaced from one another in the vertical direction, and each equipment rail 52 supports a row of three monitors M1-M3 and M4-M6, respectively. FIG. 14 shows a configuration similar to that of FIG. 13, however having an additional equipment support rail 52 supporting another row of monitors M7-M9. Even with a substantial equipment load as shown in FIG. 14, platform height adjustment means 17 and carriage depth adjustment means 19 are operable to adjust the height and depth of the equipment load in a smooth and stable manner. FIG. 15 shows a configuration similar to that of FIG. 14, however the middle equipment support rail 52 and middle row of monitors M4-M6 are removed to allow visibility through the gap between the vertically space monitor rows. Equipment rack 20 may be configured to accommodate various sizes and combinations of display monitors, including combinations that may include 32-inch, 43-inch, 49-inch, 55-inch, and 75-inch displays. In one embodiment, a monitor up to a 43-inch size (i.e., a monitor having physical dimensions of 38 inches (97 cm) by 22 inches (56 cm) can be mounted on equipment rack 20 such that a top edge of the monitor is about 44.5 inches (113 cm) above the floor level, allowing many seated users to have visibility over a top edge of the monitor. Equipment rack 20 may be cantilevered laterally from support braces 54 on equipment carriage 18 to extend substantially beyond the sidewalls 28 of base 12. Equipment rack 20 may be designed and configured to support monitors having an overall lateral span up to 100 inches (254 cm) wide. For example, four 32-inch display monitors may be mounted side-by-side in landscape orientation and configured in a semi-circular arc that will have a lateral span of approximately 98 inches (249 cm). In the example, the height of the top edge of the monitors may be limited to 39 inches (99 cm) above floor level, thereby enabling the user to readily see over top into the greater surrounding work space.

Advantageously, workstation 10 may be expanded or downsized by changing out work deck 14 and/or horizontal monitor rail(s) 52 of equipment rack 20 for other sizes.

Figure 16:
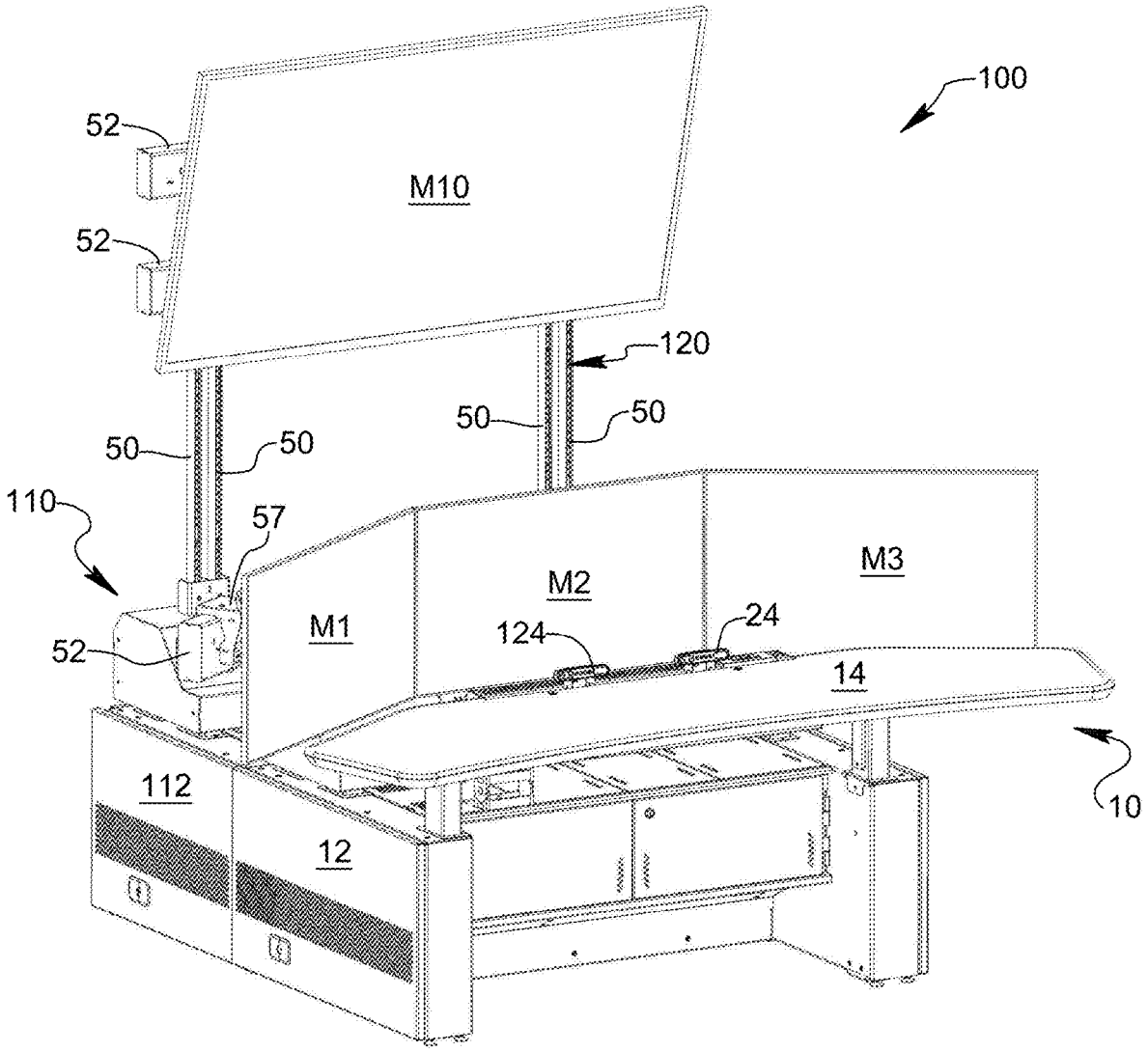
FIG. 16 is a front-left perspective view of a configurable workstation formed in accordance with a second embodiment of the present disclosure, shown supporting a plurality of display screens.
Figure 17:
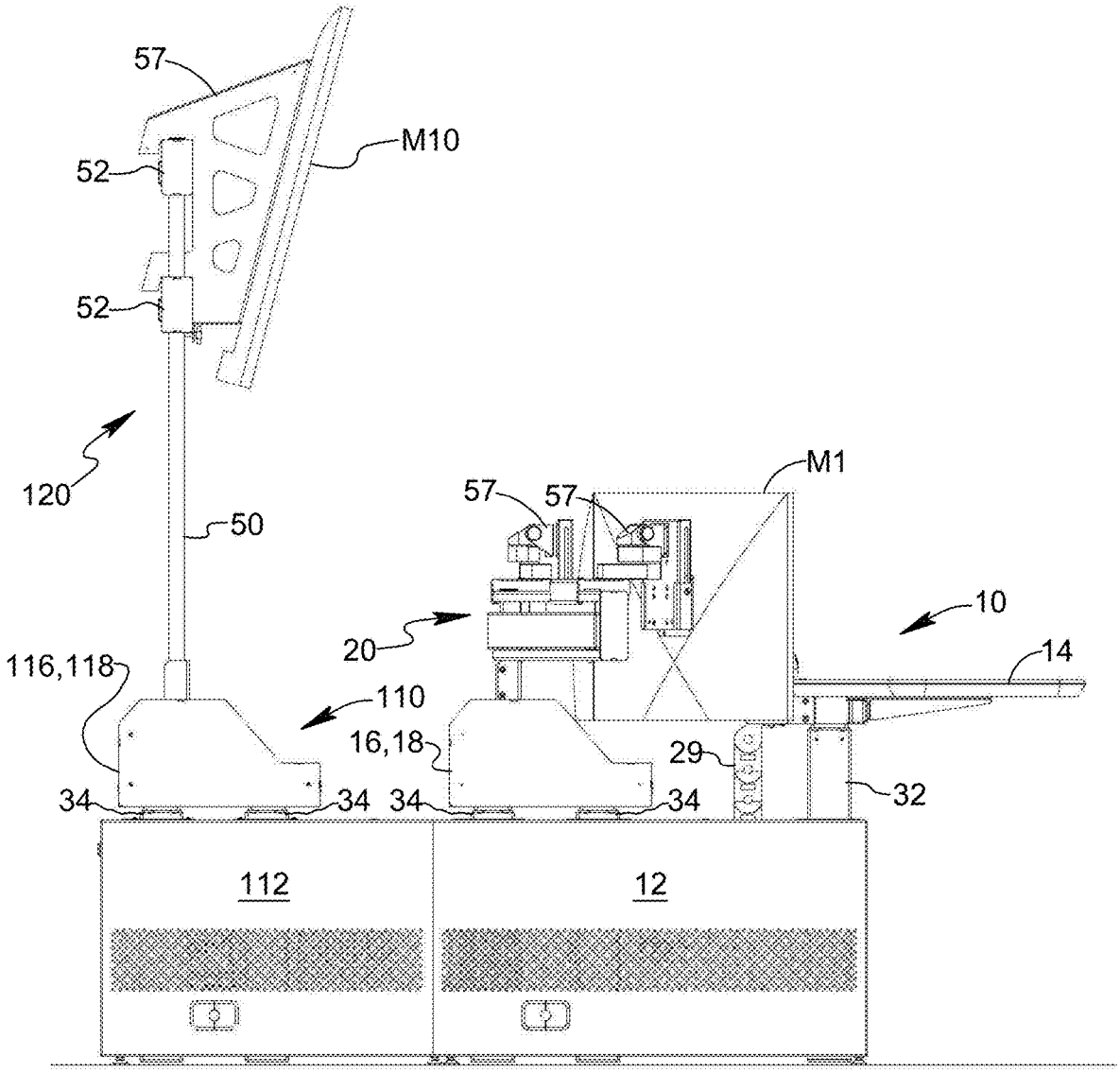
FIG. 17 is a left side elevation view of the configurable workstation shown in FIG. 16.
Figure 18:
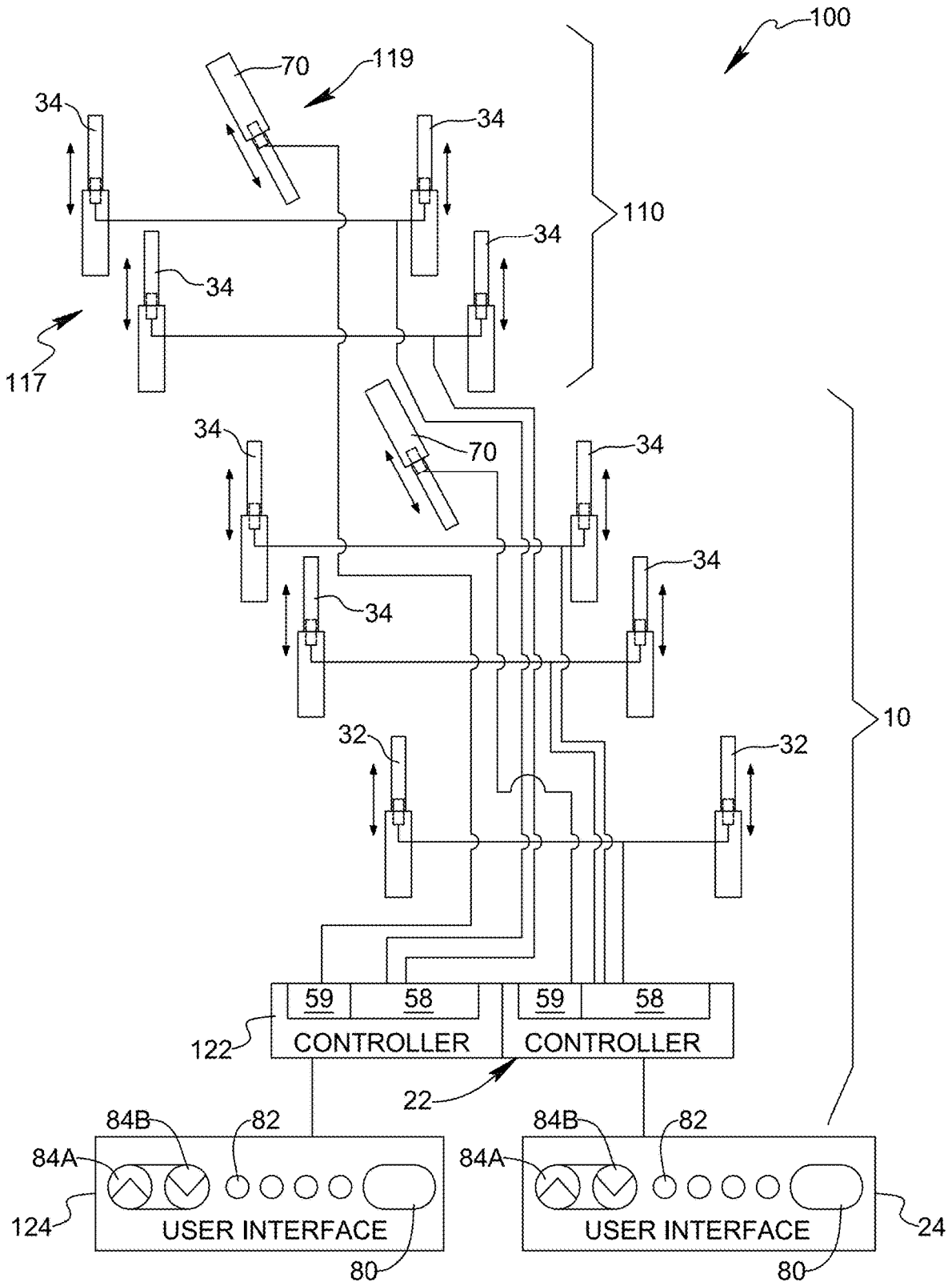
FIG. 18 is a schematic block diagram illustrating automatic control architecture of the configurable workstation of the second embodiment.

Reference is now made to FIGS. 16-18 illustrating a configurable workstation 100 formed in accordance with a second embodiment of the present disclosure. Workstation 100 may comprise a primary workstation 10 according to the first embodiment described above coupled with a secondary workstation 110 arranged directly behind primary workstation 10. Secondary workstation 110 is substantially similar to primary workstation 10, except that work deck 14 and work deck height adjustment means 15 are omitted, and a depth dimension of secondary base 112 of secondary workstation 110 is reduced relative to the depth dimension of base 12 of primary workstation 10. For example, the depth of secondary base 112 may be 24 inches (61 cm). The two bases 12, 112 of the primary and secondary workstations 10, 110 may be secured together with simple-to-install exterior connecting brackets (not shown).

Secondary workstation 110 may be used, for example, to provide a secondary equipment rack 120 ideal for a large elevated display M10. Alternatively, a height-adjustable conference table or utility counter (not shown) may be mounted on lift legs 34 of secondary workstation 110 instead of a secondary equipment platform 116 and a secondary equipment carriage 118.

As shown in FIG. 18, a secondary controller 122 and a secondary user interface 124 may be provided for controlling secondary platform height adjustment means 117 and secondary carriage depth adjustment means 119 of secondary workstation 110. Secondary controller 122 may be stored, for example, in the internal cabinet space of primary base 12 or secondary base 112, and secondary user interface 124 may be mounted for travel with work deck 14. By providing secondary controller 122 and secondary user control interface 124 separate from the controller 22 and user control interface 24 of primary workstation 10, secondary workstation 110 may be easily disconnected from primary workstation 10 and used elsewhere. Alternatively, primary controller 22 may be connected to drive the secondary lift legs 34 and secondary linear actuator 70 of secondary workstation 110, and primary user interface 24 may be configured to provide additional movement zones so that a user can issue adjustment commands to the secondary platform height adjustment means 117 and the secondary carriage depth adjustment means 119 of secondary workstation 110 by way of controller 22. It will be understood that the term "controller" as applied to workstation 100 of the second embodiment may mean a combination of primary controller 22 and secondary controller 122, and that the term "user control interface" may mean a combination of primary user control interface 24 and secondary user control interface 124.

Figure 19A:
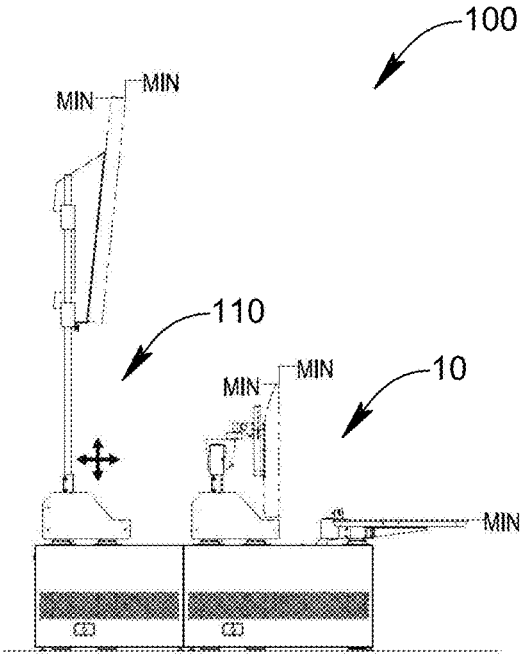
FIG. 19A is a left side elevation view of the configurable workstation of the second embodiment, wherein a work deck, a primary equipment platform, and a secondary equipment platform of the configurable workstation are adjusted to their lowest height settings and a primary carriage depth and a secondary carriage depth are adjusted to their respective rearward travel limits.
Figure 19B:
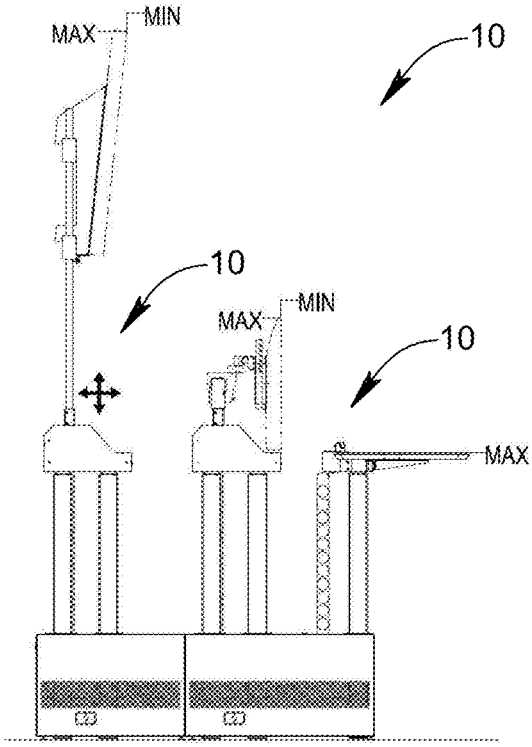
FIG. 19B is a view similar to that of FIG. 19A, wherein the work deck, the primary equipment platform, and the secondary equipment platform are adjusted to their highest height settings and the primary carriage depth and the secondary carriage depth are adjusted to their respective rearward travel limits.
Figure 19C:
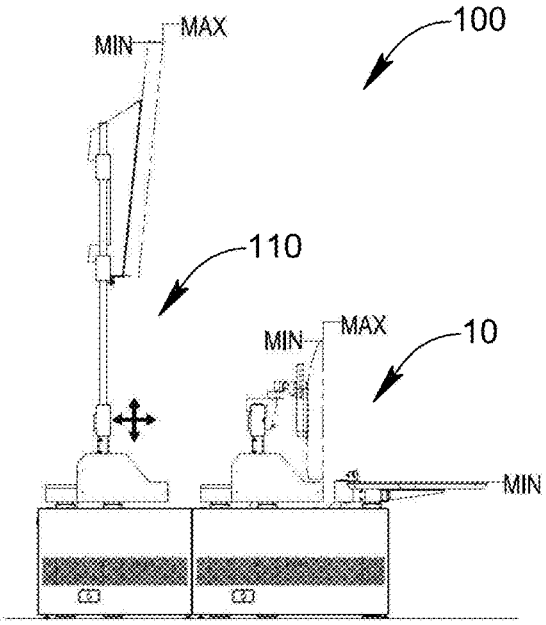
FIG. 19C is a view similar to that of FIG. 19A, wherein the work deck, the primary equipment platform, and the secondary equipment platform are adjusted to their lowest height settings and the primary carriage depth and the secondary carriage depth are adjusted to their respective forward travel limits.

FIGS. 19A-19D illustrate possible adjustment travel limits secondary equipment platform 16 and secondary equipment carriage 18 of secondary workstation 110 in conjunction with travel limits associated with primary workstation 10 as described above with reference to FIG. 10A-10D. In FIGS. 19A and 19C, secondary lift legs 34 are fully retracted and secondary equipment platform 16 is adjusted to its lowest height setting which may be generally level with primary equipment platform 16 and work deck 14. In FIGS. 10B and 10D, lift legs 34 are fully extended and secondary equipment platform 16 supporting monitor M10 is adjusted to its highest height setting. Secondary equipment platform 16 may be adjusted to different height settings within its vertical travel range. As may be seen, the height of secondary equipment carriage 18 and monitor M10 is dependent upon the height setting of secondary equipment platform 16.

Figure 19D:
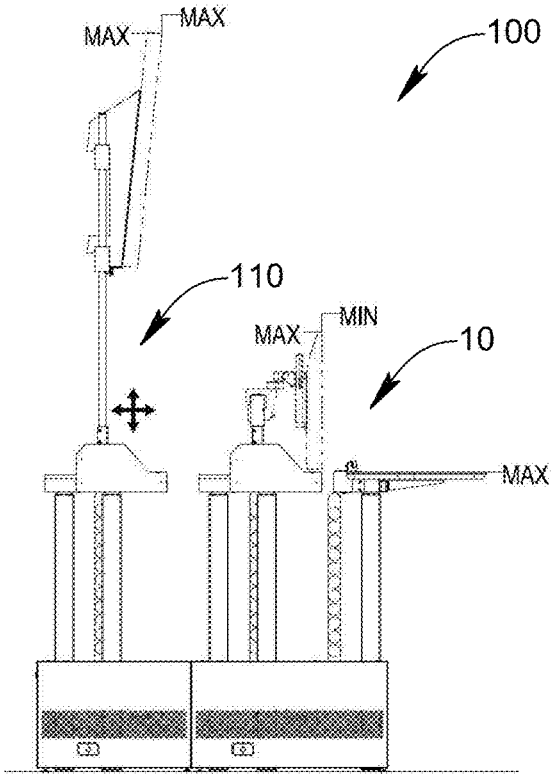
FIG. 19D is a view similar to that of FIG. 19A, wherein the work deck, the primary equipment platform, and the secondary equipment platform are adjusted to their highest height settings and the primary carriage depth and the secondary carriage depth are adjusted to their respective forward travel limits.

In FIGS. 19A and 19B, secondary linear actuator 70 (not visible) is fully retracted such that secondary equipment carriage 18 is adjusted to its rearward travel limit relative to secondary equipment platform 16, thereby positioning monitor M10 furthest from work deck 14 and a user. In FIGS. 19C and 19D, linear actuator 70 (not visible) is fully extended such that secondary equipment carriage 18 is adjusted to its forward travel limit relative to secondary equipment platform 16, thereby positioning monitor M10 closest to work deck 14 and a user. The travel range of secondary equipment carriage 18 relative to secondary equipment platform 16 in the depth direction may be the same as that for primary workstation 10, approximately 5 inches (13 cm). As may be appreciated, adjustment of a depth setting of monitor M10 may be achieved independently without adjusting the depth of secondary base 12, secondary work platform 16, and/or any of the structure associated with primary workstation 10.

Figure 20B:
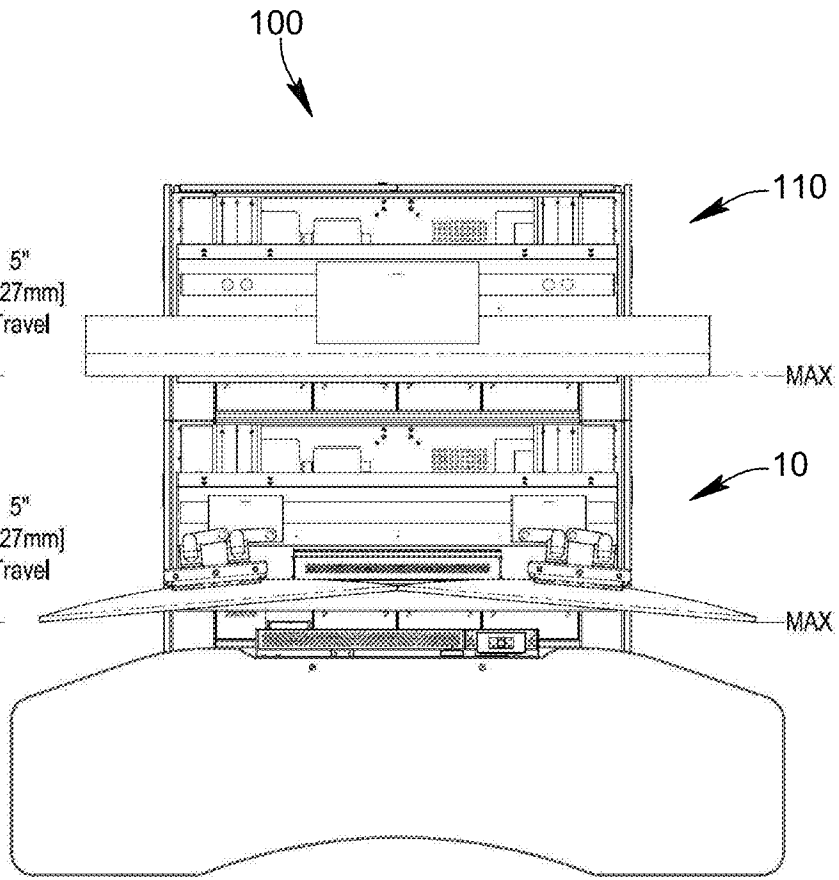
FIG. 20B is a view similar to that of FIG. 20A, wherein the primary carriage depth and the secondary carriage depth are adjusted to their respective forward travel limits.
Figure 20A:
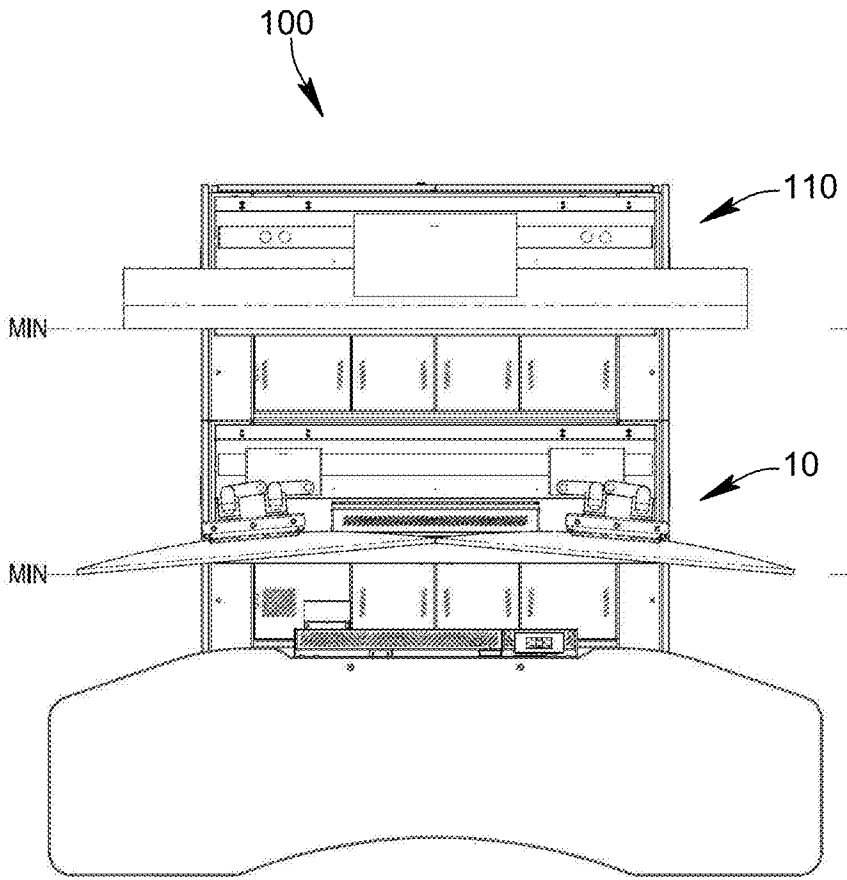
FIG. 20A is a top plan view of the configurable workstation of the second embodiment, wherein the primary carriage depth and the secondary carriage depth are adjusted to their respective rearward travel limits.

FIGS. 20A and 20B illustrate depth adjustment travel limits of workstation 100 as viewed from above. In FIG. 20A, secondary linear actuator 70 (not visible) is fully retracted such that secondary equipment carriage 18 is adjusted to its rearward travel limit relative to secondary equipment platform 16, thereby positioning monitor M10 furthest from work deck 14 and a user. In FIG. 20B, linear actuator 70 (not visible) is fully extended such that secondary equipment carriage 18 is adjusted to its forward travel limit relative to secondary equipment platform 16, thereby positioning monitor M10 closest to work deck 14 and a user. As may be seen, the depth position of work deck 14 remains unchanged.

Figure 21C:
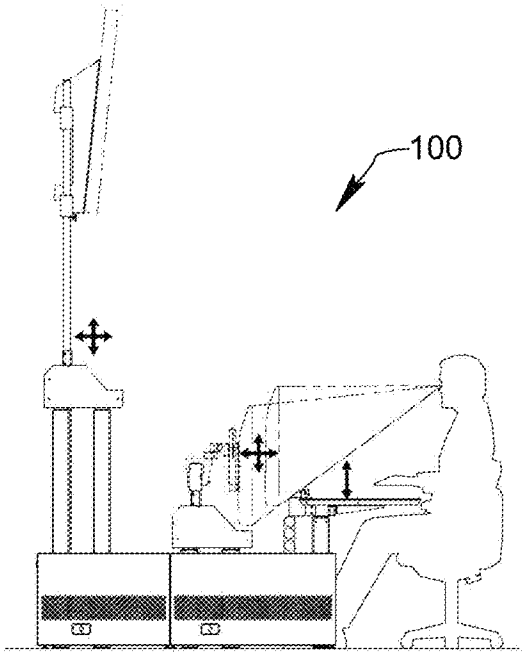
FIGS. 21A through 21C are left side elevation views illustrating user positions and adjustability degrees of freedom of the configurable workstation of the second embodiment.
Figure 21B:
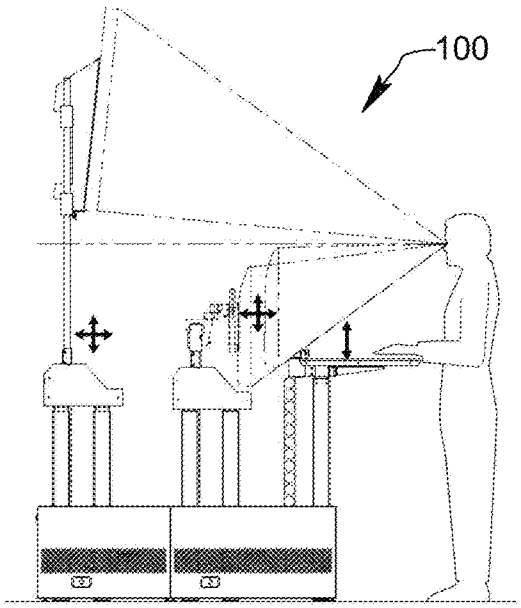
Figure 21A:
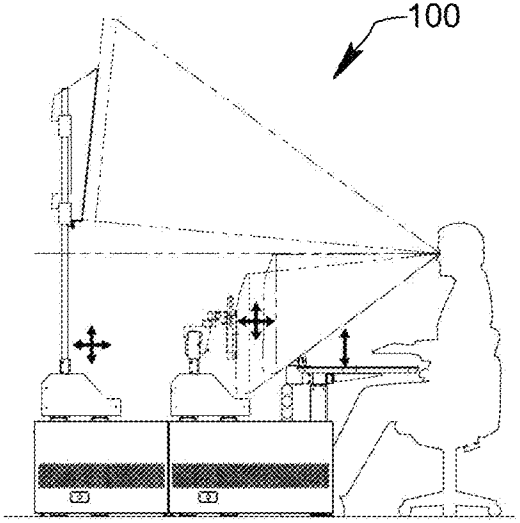

FIGS. 21A-21C illustrate adjustment degrees of freedom available to a user of workstation 100 in both the sitting and standing positions. As may be understood, full visibility of monitors M1 and M2 on primary workstation 10 and monitor M10 on secondary workstation 110 is retained even when monitors M1 and M2 are recessed such that a lower edge each monitor is below the height level of the top surface of work deck 14. Advantageously, the user may adjust the monitors M1 and M2 to have "over the top" visibility when sitting and standing and the user may raise the height of monitor M10 such that its lower edge is spaced vertically from an upper edge of monitors M1 and M2, thereby providing a visibility opening for the user between the monitors enabling interaction with coworkers.

The workstations 10 and 100 disclosed herein comply with or exceed the requirements of the ADA (including vertical travel range requirements), standards set by ANSI/BIFMA, and all international ergonomic standards known to applicant. Contiguous layouts constructed with standard sized primary bases 12 and secondary bases 12 are possible, and layouts may be linear and/or arcuate configurations. The workstations 10 and 100 disclosed herein facilitate adjustments for comfort, good posture and ocular depth of field exercise. The disclosed workstations have modular components that can be repaired or replaced, and the workstations are easy to install as well as disassemble and move to another location.

Workstations 10 and 100 having motorized bi-directional monitor rack adjustment provide users and information technology technicians with the means, at the touch of a button, to make many of the time-to-time desired and required adjustments. Workstations 10 and 100 provide compact base, platform, and carriage modules that may be assembled in the factory and completed at the installation site by installing extended cantilevered work decks and equipment support racks.

While the present disclosure describes exemplary embodiments, the detailed description is not intended to limit the scope of the appended claims to the particular embodiments set forth. The claims are intended to cover such alternatives, modifications and equivalents of the described embodiments as may be included within the scope of the claims.

What is claimed is:

1. A workstation comprising:

a primary base;

a work deck connected to the primary base;

work deck height adjustment means for automatically adjusting a height of the work deck relative to the primary base;

a primary equipment platform connected to the primary base;

a primary platform height adjustment means for automatically adjusting a height of the primary equipment platform relative to the primary base;

a primary equipment carriage supported on the primary equipment platform, wherein the primary equipment carriage carries a pair of laterally spaced support braces, wherein the primary equipment carriage is mounted on the primary equipment platform by a pair of slide rails respectively located under the pair of support braces and a plurality of followers slidably mating with the pair of slide rails, each slide rail of the pair of slide rails having a pair of parallel guides slidably mating with at least one of the plurality of followers;

a primary carriage depth adjustment means for automatically adjusting a depth of the primary equipment carriage relative to the primary equipment platform and the work deck, wherein the plurality of followers do not extend beyond the parallel guides in a depth direction of the primary carriage depth adjustment means;

a primary equipment support rack supported on the primary equipment carriage by a pair of vertical support posts removably received one in each of the pair of support braces;

a controller in communication with the work deck height adjustment means, the primary platform height adjustment means, and the primary carriage depth adjustment means; and a user control interface in communication with the controller and configured to enable a user to issue adjustment commands to the work deck height adjustment means, the primary platform height adjustment means, and the primary carriage depth adjustment means by way of the controller.

2. The workstation according to claim 1, wherein the user control interface is coupled with the work deck for travel with the work deck.

3. The workstation according to claim 1, wherein the primary base includes a console having an interior storage space.

4. The workstation according to claim 3, further comprising a power and data connector strip extending along a rear edge of the work deck and a flexible cable guide extending from the interior storage space of the console to the power and data connector strip.

5. The workstation according to claim 3, further comprising a flexible cable guide extending from the interior storage space of the console to the primary equipment carriage.

6. The workstation according to claim 1, wherein the primary carriage depth adjustment means can adjust the depth of the primary equipment carriage relative to the primary equipment platform and the work deck without adjusting the height of the primary equipment platform relative to the primary base.

7. The workstation according to claim 1, wherein a depth range of motion of the primary carriage depth adjustment means is equal to five inches.

8. The workstation according to claim 1, wherein the pair of slide rails are fixed to the primary equipment platform and the plurality of followers are fixed to the primary equipment carriage.

9. The workstation according to claim 8, wherein the pair of slide rails include a pair of extruded one-piece slide rails located one at each opposite lateral side of the primary equipment platform.

10. The workstation according to claim 1, wherein the primary equipment platform is rectangular and is connected to the primary base by four automatically extendable and retractable lift legs respectively located at the corners of the rectangular primary equipment platform.

11. The workstation according to claim 1, wherein the primary equipment carriage includes a cable tray for receiving electrical power and data cables.

12. The workstation according to claim 1, further comprising:

a secondary base behind the primary base;

a secondary equipment platform connected to the secondary base;

a secondary platform height adjustment means for automatically adjusting a height of the secondary equipment platform relative to the secondary base;

a secondary equipment carriage supported on the secondary equipment platform, wherein the secondary equipment carriage carries a pair of laterally spaced secondary support braces, wherein the secondary equipment carriage is mounted on the secondary equipment platform by a pair of secondary slide rails respectively located under the pair of secondary support braces and a plurality of secondary followers slidably mating with the pair of secondary slide rails, each secondary slide rail of the pair of secondary slide rails having a pair of secondary parallel guides slidably mating with at least one of the plurality of secondary followers;

a secondary carriage depth adjustment means for automatically adjusting a depth of the secondary equipment carriage relative to the secondary equipment platform and the work deck, wherein the plurality of secondary followers do not extend beyond the secondary parallel guides in a depth direction of the secondary carriage depth adjustment means; and a secondary equipment support rack supported on the secondary equipment carriage by a pair of secondary vertical support posts removably received one in each of the pair of secondary support braces;

wherein the controller is in communication with the secondary platform height adjustment means and the secondary carriage depth adjustment means;

wherein the user control interface is configured to enable a user to issue adjustment commands to the secondary platform height adjustment means and the secondary carriage depth adjustment means by way of the controller.

13. The workstation according to claim 12, wherein each secondary slide rail has a plate portion, and the pair of parallel guides of the secondary slide rail are cylindrical guides extending along opposite lateral side edges of the plate portion of the secondary slide rail and raised relative to the plate portion of the secondary slide rail.

14. The workstation according to claim 1, wherein each slide rail of the pair of slide rails has a plate portion, and the pair of parallel guides of the slide rail are cylindrical guides extending along opposite lateral side edges of the plate portion and raised relative to the plate portion.

* * * * *